US008509650B2

(12) United States Patent
Kikuchi et al.

(10) Patent No.: US 8,509,650 B2
(45) Date of Patent: Aug. 13, 2013

(54) ELECTROPHOTOGRAPHIC IMAGE FORMING APPARATUS

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/726,783

(22) Filed: Mar. 18, 2010

(65) Prior Publication Data

US 2010/0247140 A1 Sep. 30, 2010

(30) Foreign Application Priority Data

Mar. 23, 2009 (JP) ..... 2009-069961
Oct. 16, 2009 (JP) ..... 2009-239164

(51) Int. Cl.
*G03G 21/16* (2006.01)

(52) U.S. Cl.
USPC ..... 399/111; 399/110; 399/113; 399/120; 399/121; 399/360

(58) Field of Classification Search
USPC ..... 399/110, 111, 120, 121
See application file for complete search history.

(56) References Cited

U.S. PATENT DOCUMENTS 6,029,033 A * 2/2000 Kawasaki ..... 399/149
6,141,513 A 10/2000 Nishiuwatoko et al.
6,336,012 B1 1/2002 Noda et al.
6,366,746 B1 4/2002 Sasago et al.
6,385,413 B2 5/2002 Sasaki et al.
6,606,469 B2 8/2003 Kikuchi et al.
6,968,138 B2 11/2005 Akutsu
7,127,195 B2 * 10/2006 Kimura et al. ..... 399/116
7,221,887 B2 * 5/2007 Kimura et al. ..... 399/101
7,515,838 B2 * 4/2009 Kadowaki et al. ..... 399/13
7,917,078 B2 * 3/2011 Tsusaka et al. ..... 399/360
8,233,817 B2 7/2012 Sakuma
2003/0053819 A1 3/2003 Nomura et al.
2005/0002688 A1 * 1/2005 Jeong et al. ..... 399/110
2006/0153589 A1 * 7/2006 Sato et al. ..... 399/110
2006/0269305 A1 * 11/2006 Murakami et al. ..... 399/35
2007/0059033 A1 * 3/2007 Kitozaki ..... 399/110
2007/0147890 A1 6/2007 Hayakawa (Continued)

FOREIGN PATENT DOCUMENTS

JP 2006-184901 7/2006
JP 2009-181077 A 8/2009

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus for forming an image on a sheet includes a transfer member for transferring a developed image formed on an electrophotographic photosensitive drum onto the sheet; a cartridge mounting portion for demountably mounting a cartridge accommodating the developer; an image forming unit movable, relative to a main assembly of the apparatus in a state that the cartridge is mounted to the mounting portion, between an image forming position for effecting image formation and a mounting and demounting position, away from the image formation position, for mounting and demounting the cartridge to the mounting portion; a cleaning member for removing a developer remaining on a surface of the drum; a residual developer container, demountably mounted to the image forming unit, for accommodating the developer removed by the cleaning member; wherein the residual developer container and the cartridge are detachably mountable individually relative to the image forming unit when the image forming unit is placed in the mounting and demounting position.

2 Claims, 29 Drawing Sheets

(56) References Cited

U.S. PATENT DOCUMENTS

| | | | | |
|---|---|---|---|---|
| 2007/0160380 | A1 | 7/2007 | Imaizumi et al. | |
| 2007/0160386 | A1 | 7/2007 | Kawamura | |
| 2008/0181658 | A1 | 7/2008 | Okabe | |
| 2009/0123189 | A1* | 5/2009 | Ichiki et al. | 399/257 |
| 2009/0196652 | A1 | 8/2009 | Sakuma | |
| 2009/0324284 | A1* | 12/2009 | Ohta | 399/120 |
| 2012/0269536 | A1 | 10/2012 | Sakuma | |

* cited by examiner (a)

(b)

(c)

(a)

(b)

(a)

(b)

ELECTROPHOTOGRAPHIC IMAGE FORMING APPARATUS

FIELD OF THE INVENTION AND RELATED ART

The present invention relates to an electrophotographic image forming apparatus for forming an image on a recording material, wherein cartridge is dismountably mounted to a main assembly of the apparatus. Here, the electrophotographic image forming apparatus forms a color image on the recording material using an electrophotographic image forming process. The examples of the electrophotographic image forming apparatus include an electrophotographic copying machine, an electrophotographic printer (a laser beam printer, an LED printer, for example), a facsimile device, and a word processor. The image is formed by the image forming apparatus on a recording material, and the recording material is paper, an OHP sheet, for example. The cartridge is a process cartridge, a developing cartridge or the like and contributes to an image forming process for forming the image on the recording material in the state that it is mounted to the main assembly of the image forming apparatus. Here, the process cartridge contains at least one of the charging means, developing means, cleaning means as process means, and the electrophotographic photosensitive drum (drum) as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the drum as a unit, and it is dismountably mounted to the main assembly. The process cartridge which is provided integrally with the drum and the developing means is called an integral-type process cartridge. The process cartridge which is provided integrally with the drum and the process means other than the developing means is called a discrete type process cartridge. In this case, the developing means is provided in a developing unit unintegral with the process cartridge, and the discrete type process cartridge forms the image using the combination with such a developing unit. The mounting and demounting of the process cartridge can be carried out relative to the main assembly by a user. For this reason, the maintenance of the apparatus is easy. The process means is actable on the electrophotographic photosensitive drum. The developing cartridge has the developing roller, contains the powdery developer toner having developed the electrostatic latent image formed on the drum by the developing roller used, and is mounted to the apparatus main assembly dismountably. In the case of the developing cartridge, the drum is mounted to a main assembly or a cartridge supporting member. Or, the drum is provided in a so-called discrete type process cartridge In this case, the process cartridge is not provided with the developing means. The developing cartridge can also carry out the mounting and demounting relative to said main assembly by the user. For this reason, the maintenance of the apparatus is easy. Therefore, the cartridge in this invention includes the process cartridges of a so-called the integral type or a so-called discrete type. The cartridge includes a combination of the so-called process cartridge of the discrete type and the developing cartridge. In another example of the cartridge, the drum is mounted fixedly to the main assembly or the cartridge supporting member, and the detachably mountable developing cartridge acts on the electrophotographic photosensitive drum. As has been described hereinbefore, the image forming apparatus for forming the image on the recording material using the image forming process is known. In this image forming apparatus, the process cartridge type described above is known. In addition, the developing cartridge type which comprises only the developing unit unintegral with the drum is known. In the present invention, the process cartridge type and the developing cartridge type are usable. The process cartridge and the developing cartridge are provided with a developer accommodating portion which contains the developer (toner) for developing the electrostatic latent image.

Here, an image forming apparatus capable of forming color images is known. A known image forming apparatus employs a cartridge tray as a drawer member which carries a plurality of cartridge, and the cartridge tray is drawn in the direction in which the cartridges are juxtaposed, by which an exchanging operation of the cartridge is made easy (Japanese Laid-open Patent Application No. 2006-184901).

SUMMARY OF THE INVENTION

In the image forming apparatus, a developing device for containing the developer is mounted in the member in the form of the drawer. When the developer in the developing device is exhausted, the drawer-like member is drawn out and the developing device is exchanged. Furthermore, a cleaning device for scraping off and accommodating the residual developer which remains on the transportation belt and so on is mounted to the different the member in the form of the drawer called a belt holder from the drawer-like member described above. When the cleaning device is full of the residual developer, the belt holder is drawn, and the cleaning device is exchanged with a new cleaning device. As to devices exchanged at a relatively high frequency such as the developing device and cleaning device, a user handles the different units (drawer-like member and belt holder). An object of the present invention is to provide an electrophotographic image forming apparatus, wherein the exchanging operation for the cartridge which contains the developer and for the residual developer container which contains the residual developer is improved. It is a further object of the present invention to provide a an electrophotographic image forming apparatus, wherein when an image forming unit is in a mounting and dismounting position, the residual developer container is detachably mountable relative to the image forming unit, by which the operativity in the exchanging operation for the residual developer container is improved.

According to the present invention, the exchanging operation of the cartridge which contains the developer, and the residual developer container which contains the residual developer, can be improved. In the present invention, when the image forming unit is in the mounting and dismounting position, the residual developer container is detachably mountable relative to the image forming unit, and therefore, the operativity in the exchanging operation for the residual developer container is improved.

These and other objects, features, and advantages of the present invention will become more apparent upon consideration of the following description of the preferred embodiments of the present invention, taken in conjunction with the accompanying drawings.

Figure 3:
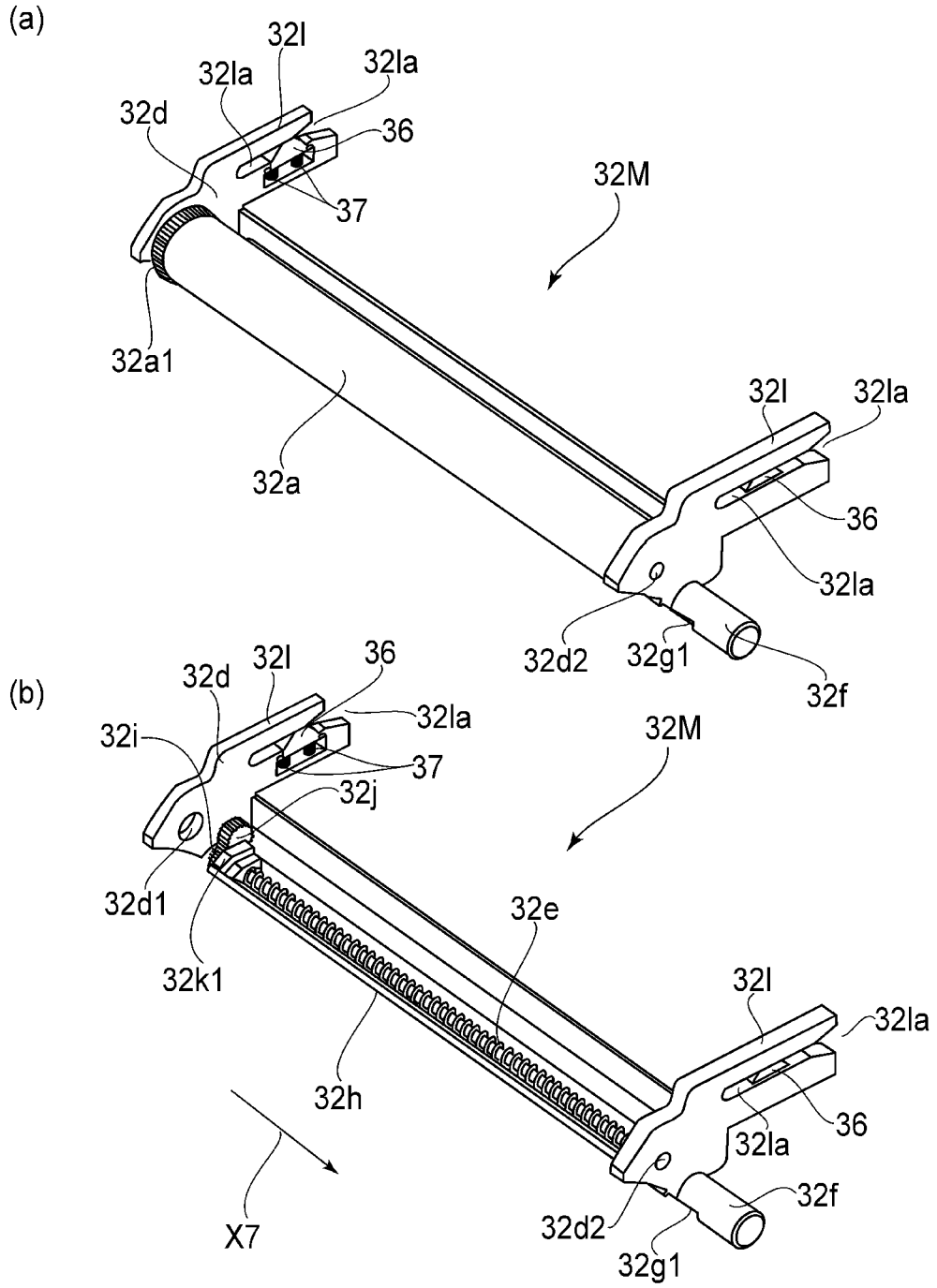

Part (a) of FIG. 3 is a left-hand side perspective view of one photosensitive member unit, and (b) is a perspective view of the photosensitive member unit (photosensitive member case) from which a drum, a charging roller, and a cleaning blade are dismounted.

Figure 4:
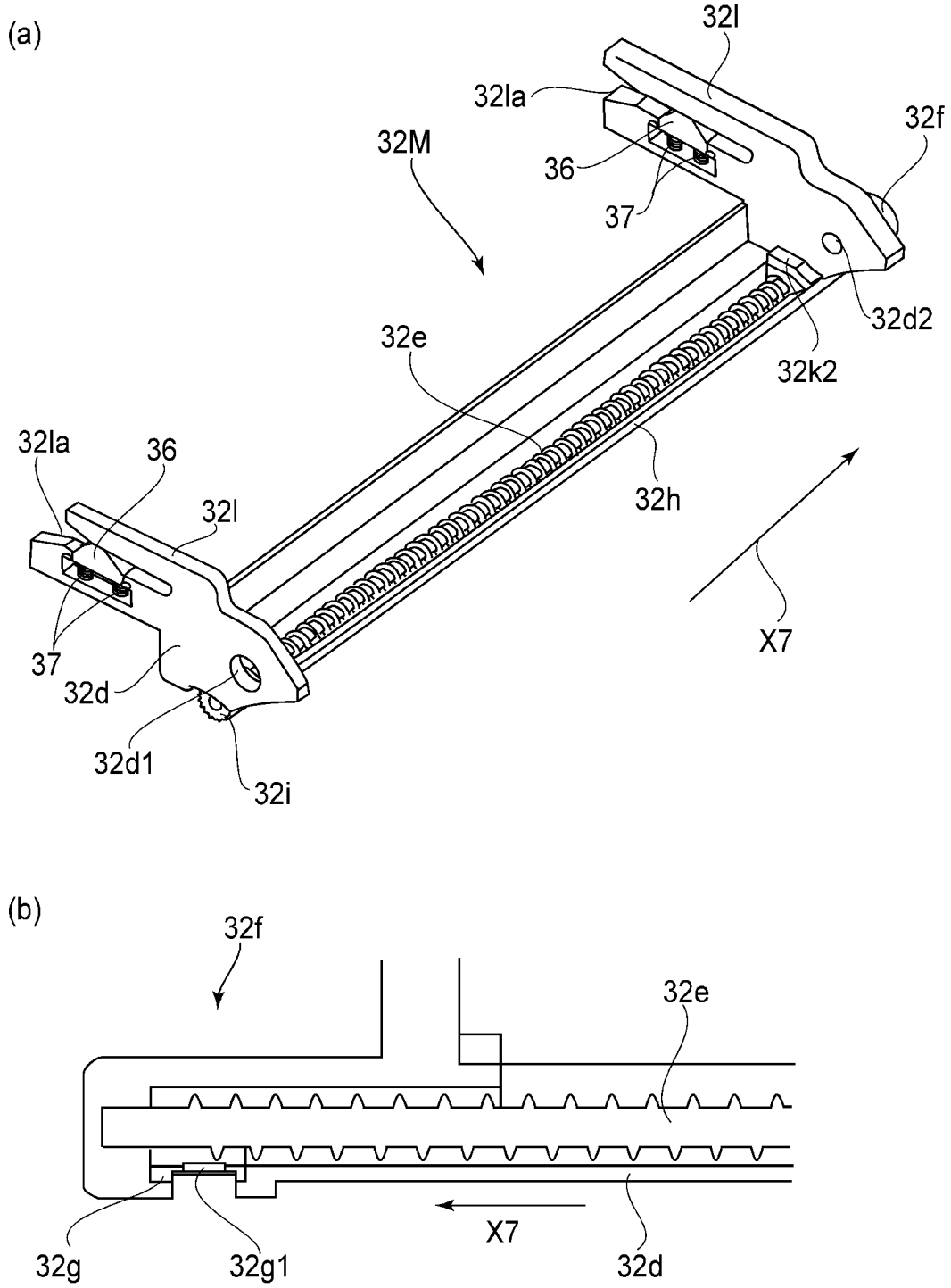

Part (a) of FIG. 4 is a right-hand side perspective view of the photosensitive member case of (b) of FIG. 3, and (b) is an enlarged vertical longitudinal sectional view of a removed developer discharging portion of the photosensitive member case.

Figure 5:
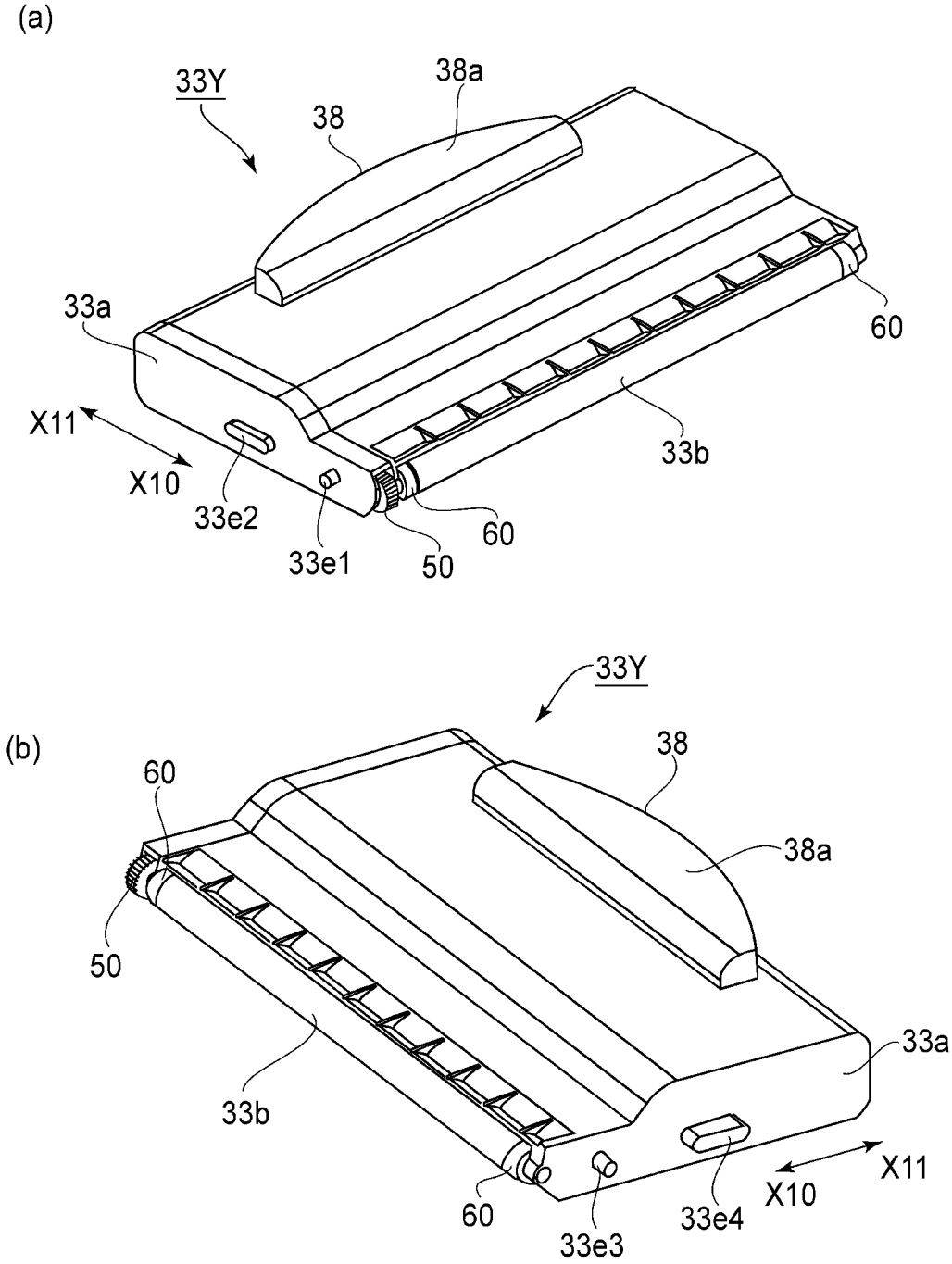

Part (a) of FIG. 5 is a right-hand side perspective view of a cartridge, and (b) is a left-hand side perspective view thereof.

Figure 6A:
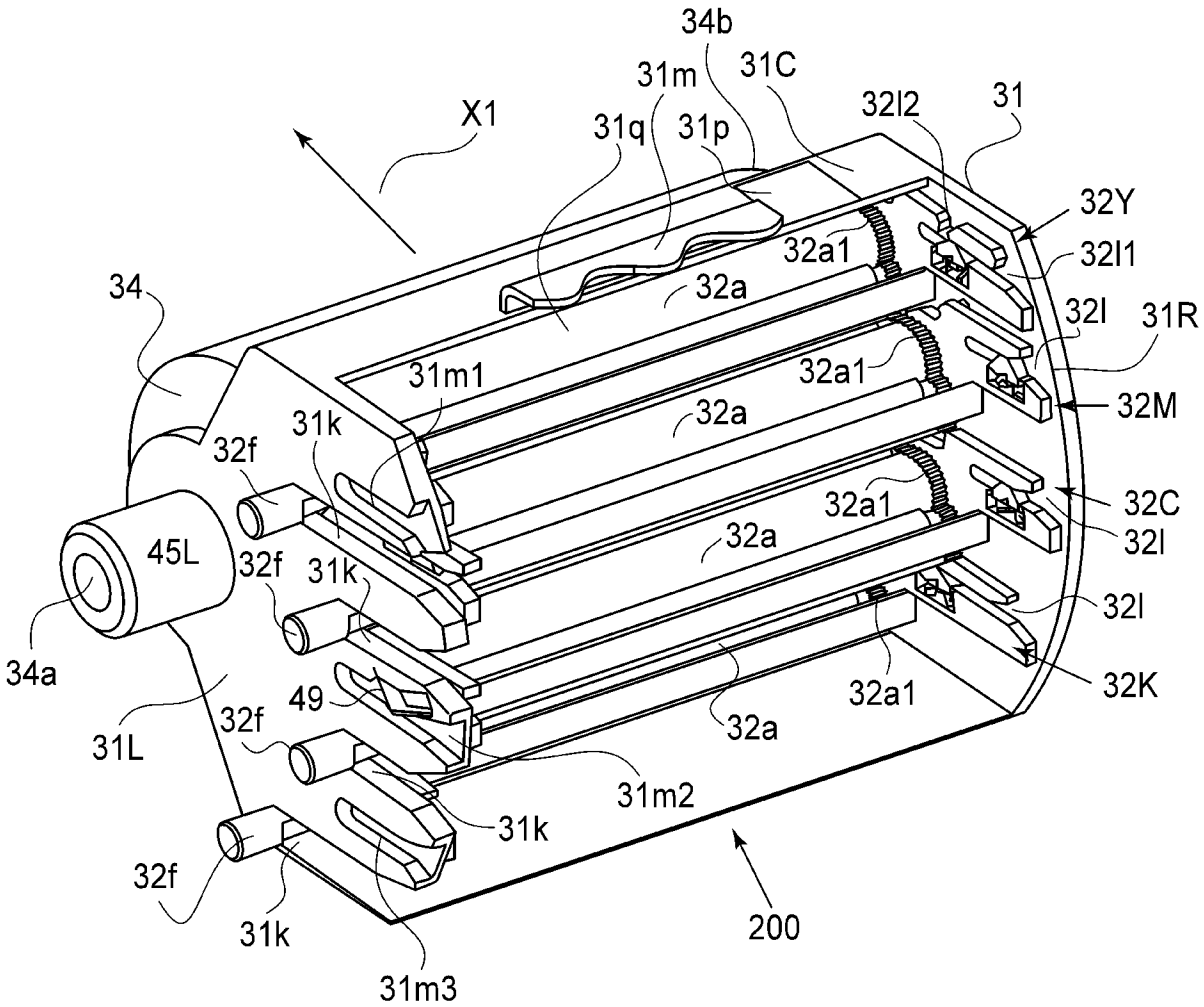
Figure 6B:
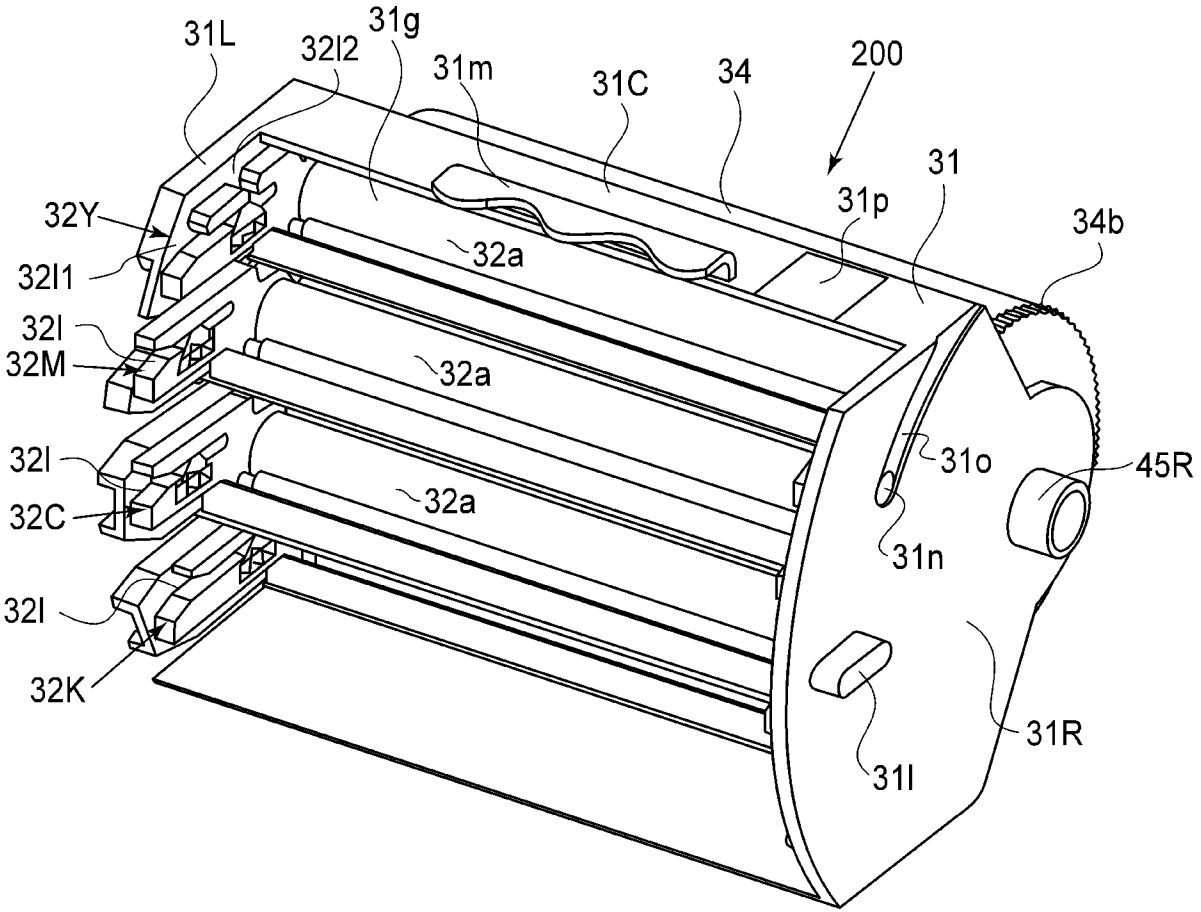

FIG. 6A is a left-hand side perspective view of an image forming unit, and, and FIG. 6B is a right-hand side perspective view thereof.

Figure 7:
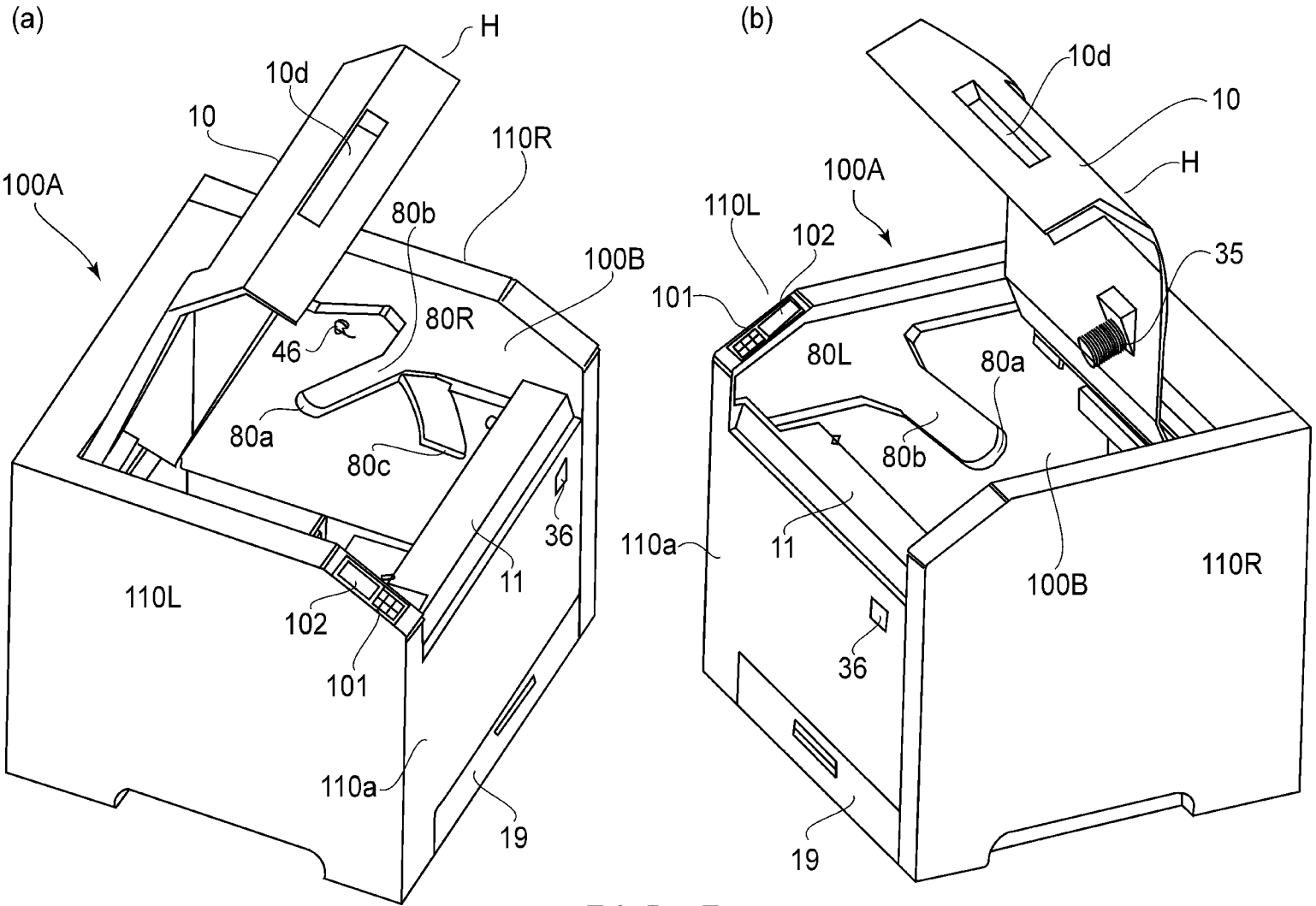

Part (a) of FIG. 7 is a left-hand side perspective view of a main assembly in the state that a maintenance cover is open, and (b) is a right-hand side perspective view thereof.

Figure 8:
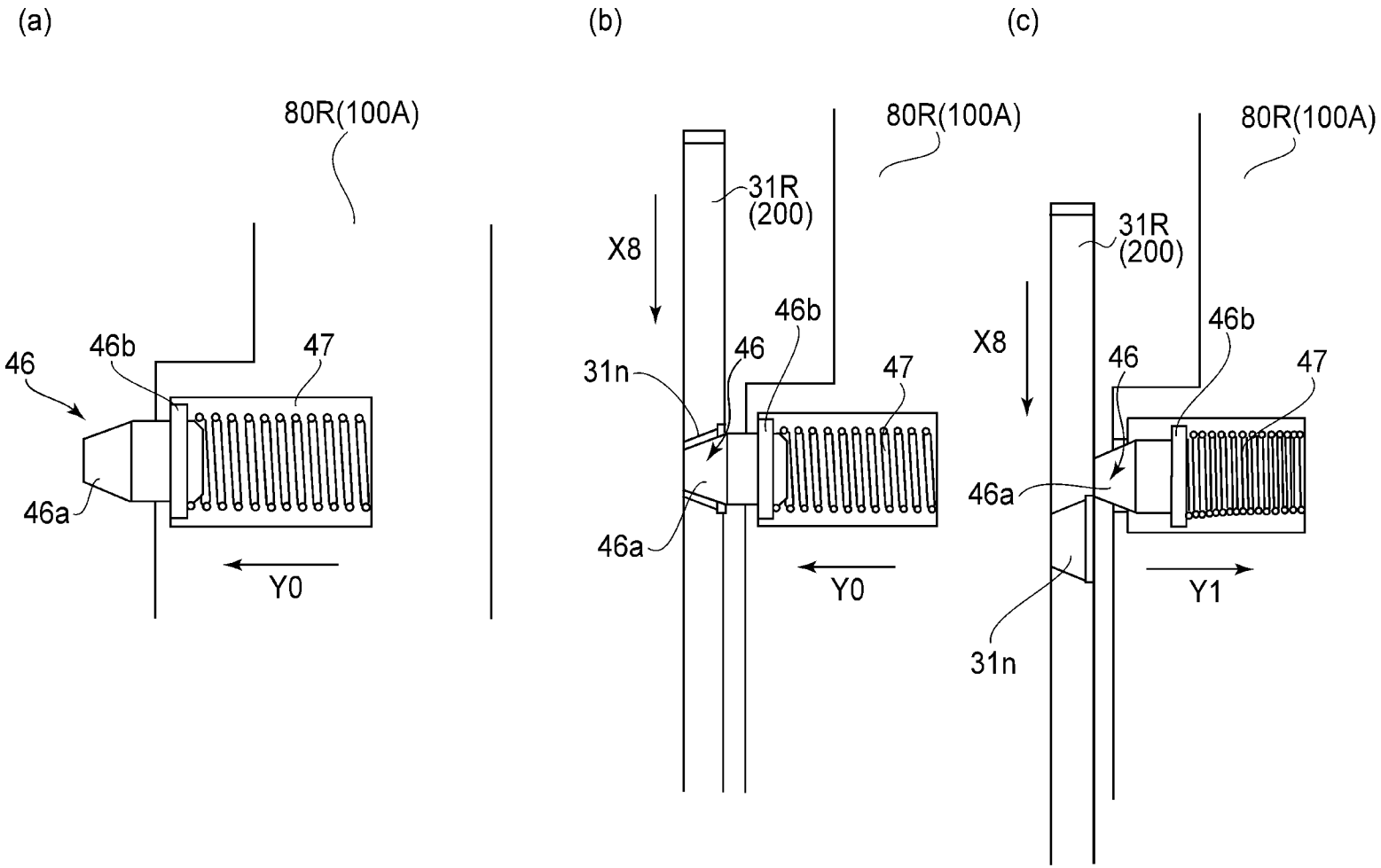

FIG. 8 is an illustration of a regulating portion of the main assembly and the portion-to-be-regulated of the image forming unit.

Figure 9:
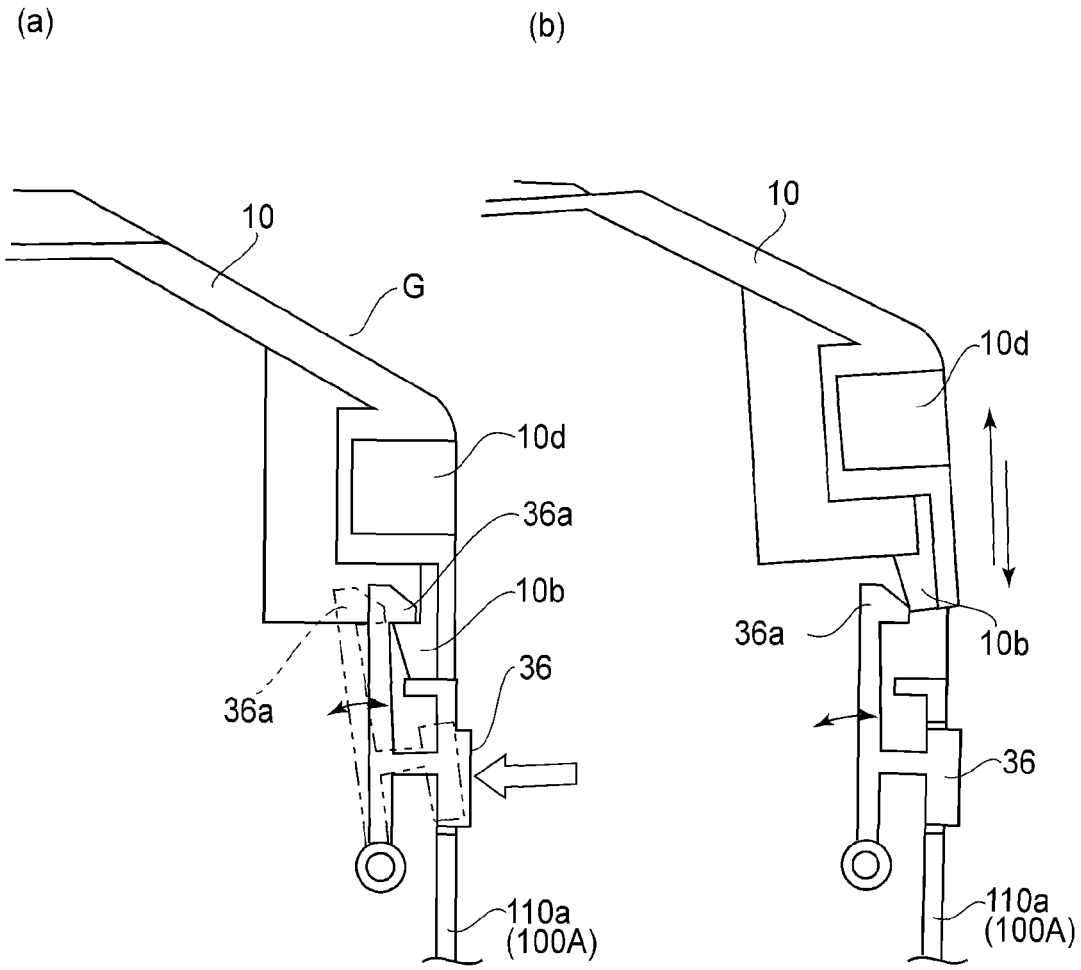

FIG. 9 is an illustration of a maintenance button.

Figure 10:
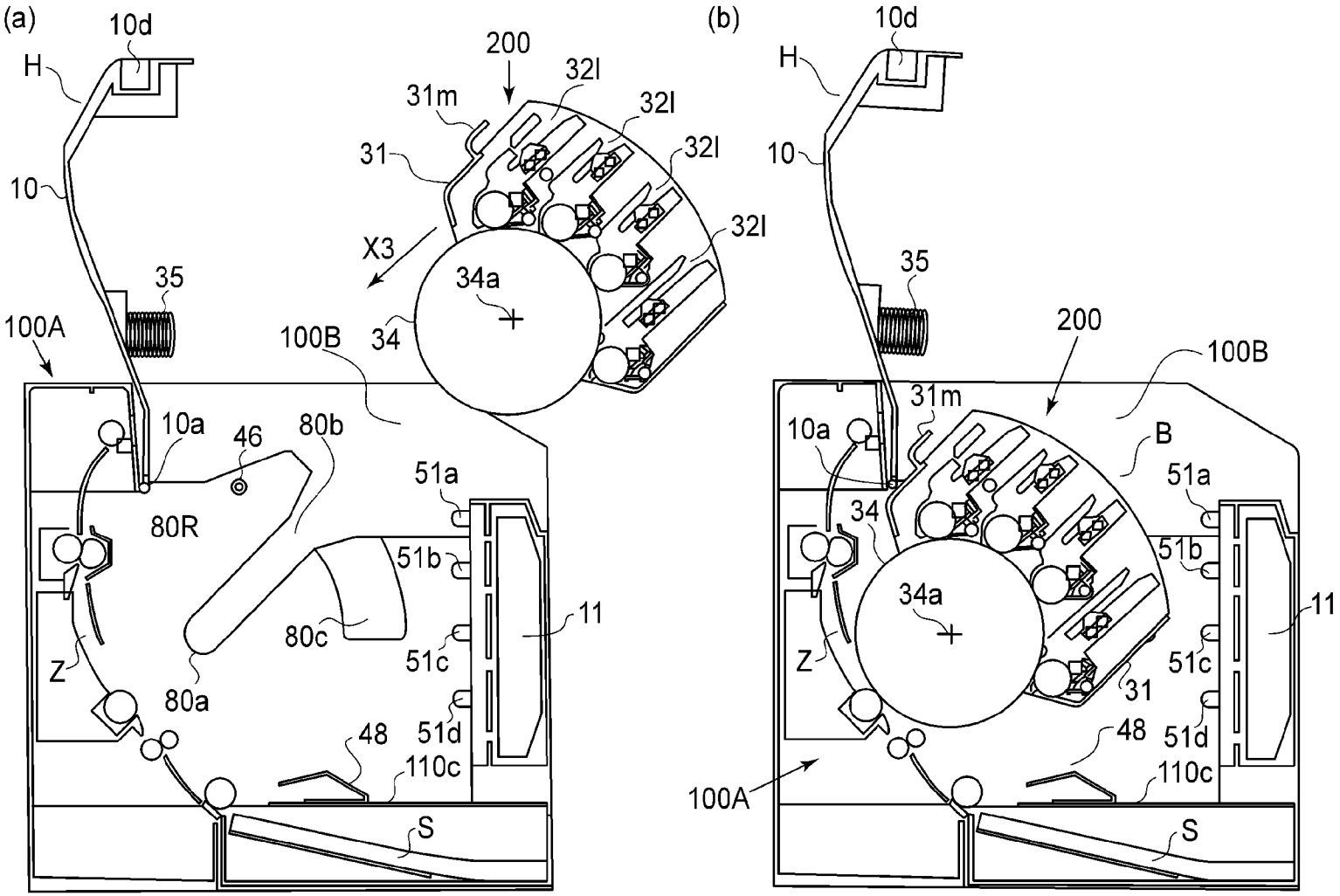

FIG. 10 is an illustration of the mounting process of the image forming unit relative to the main assembly.

Figure 11A:
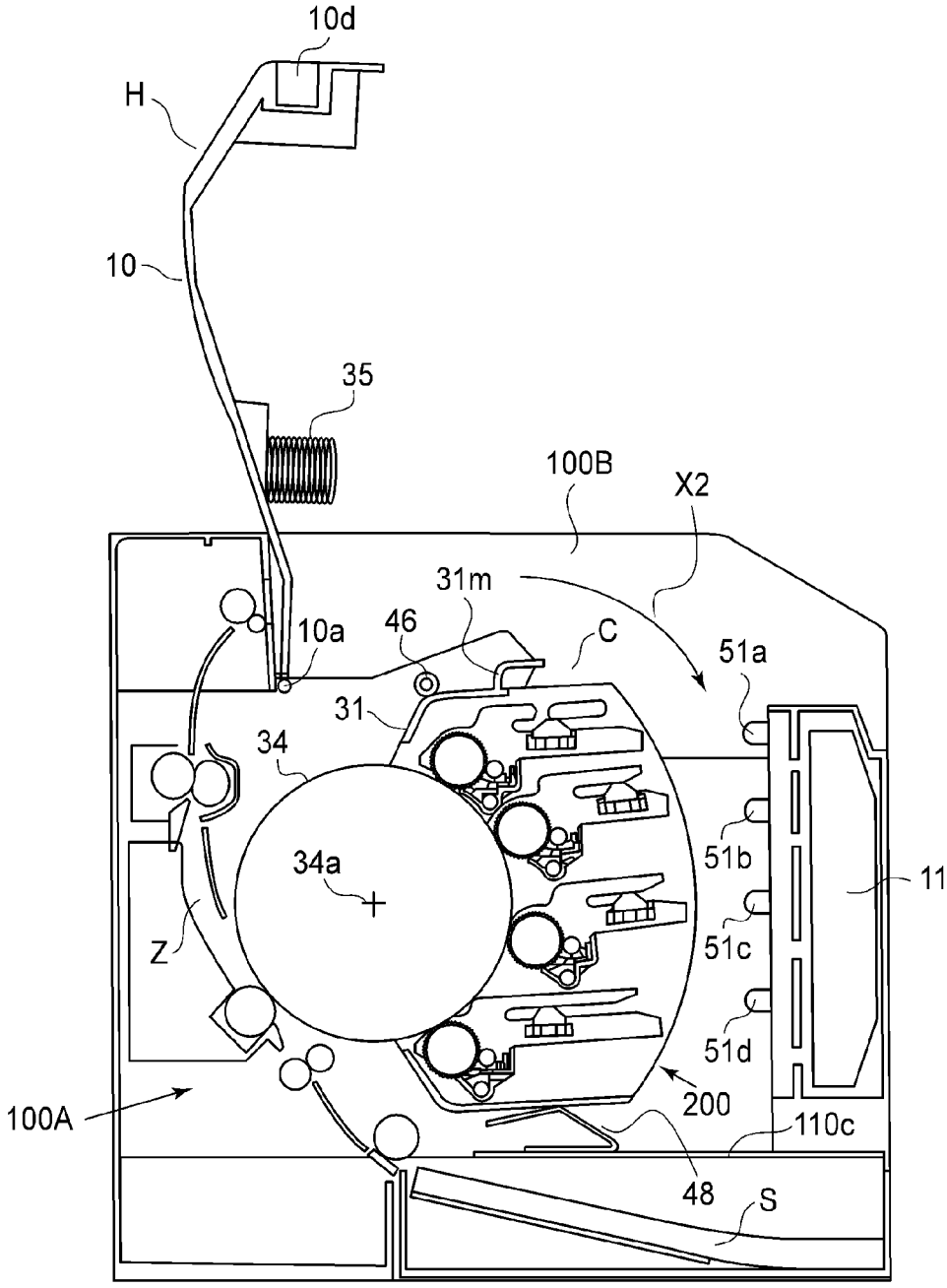
Figure 11B:
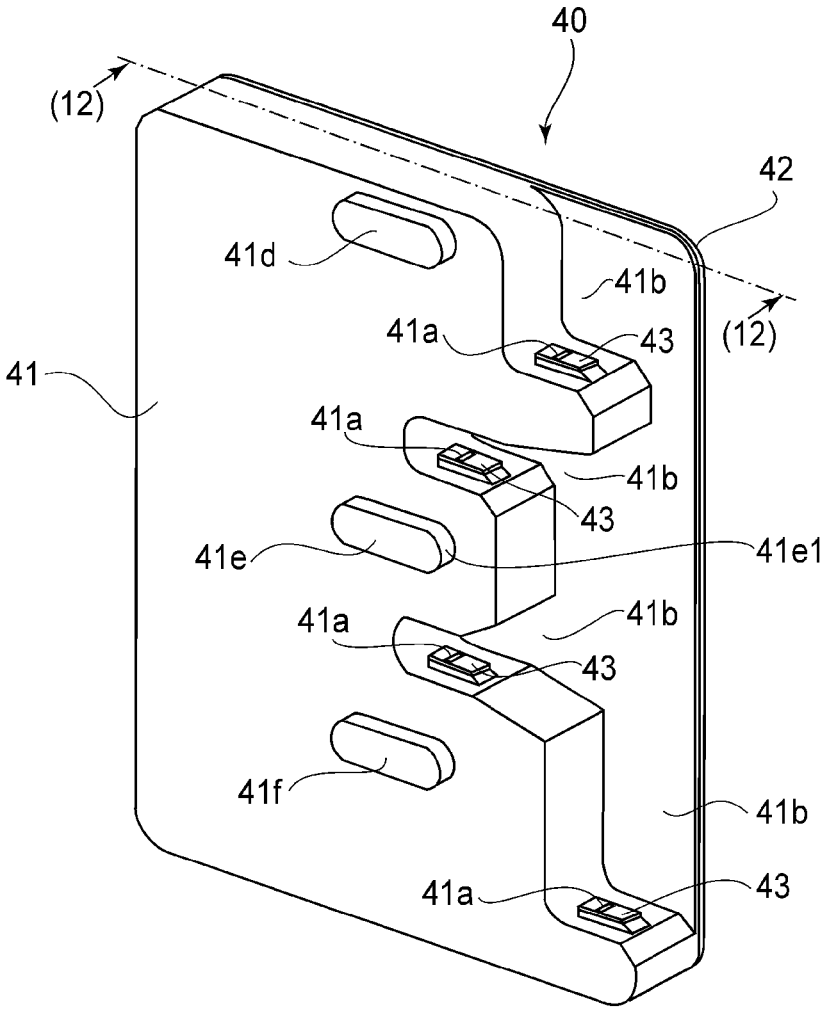

FIG. 11A is an illustration of a mounting process of the image forming unit to the main assembly, and FIG. 11B is a right-hand side perspective view of the residual developer container.

Figure 12:
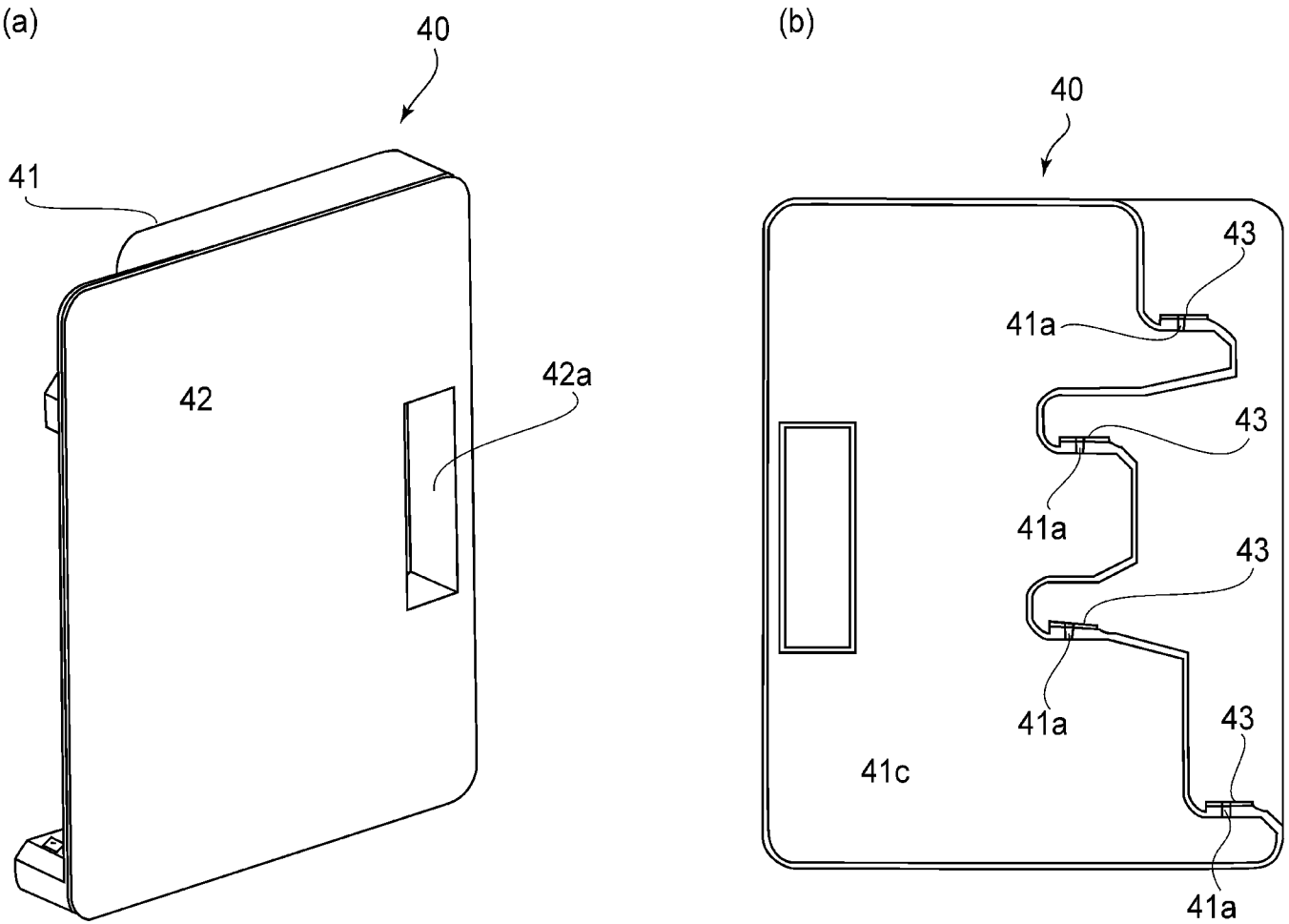

Part (a) of FIG. 12 is a left-hand side perspective view of the residual developer container, and (b) is a sectional view taken along the line (12)-(12) of FIG. 11B.

Figure 13:
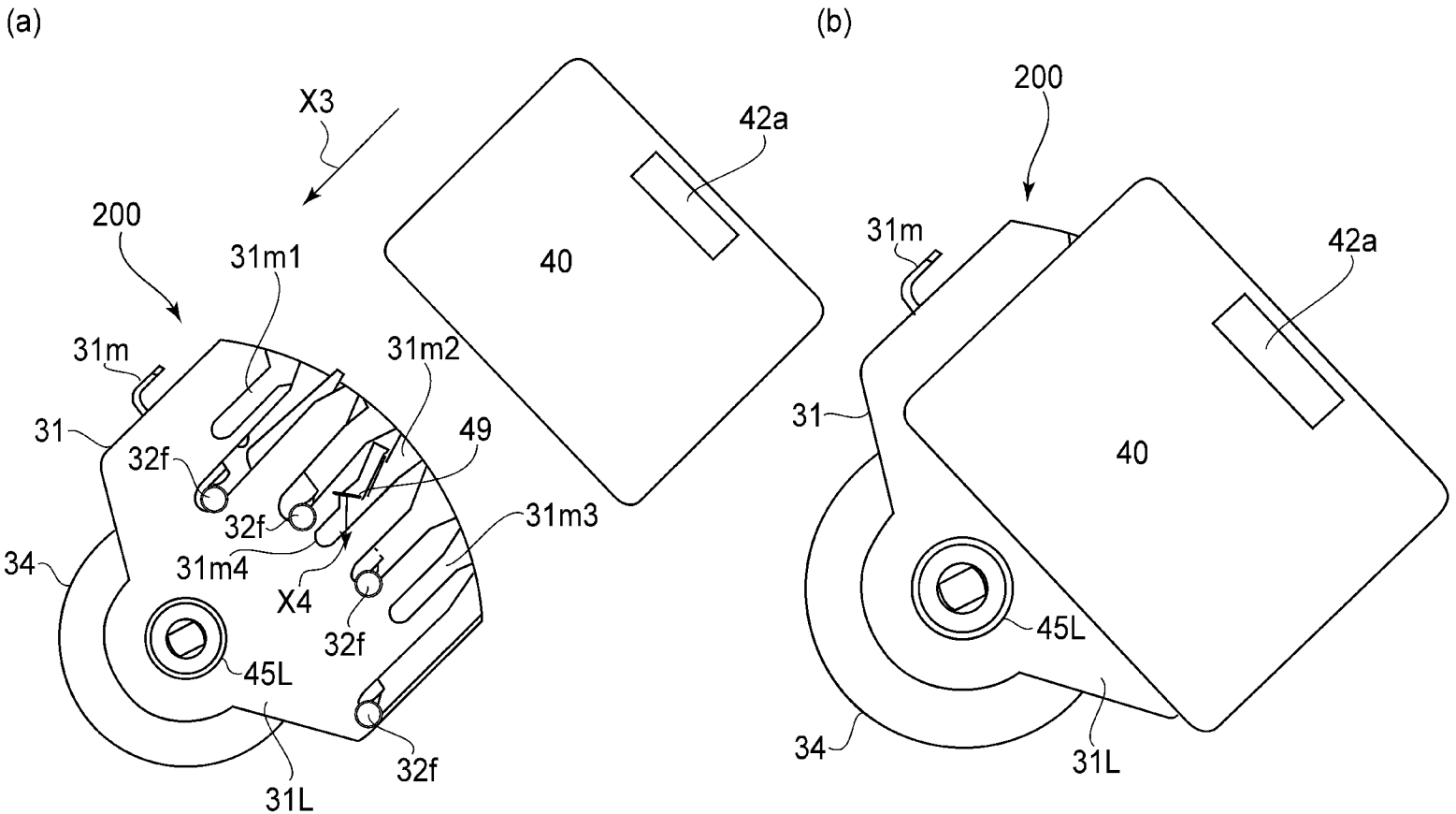

FIG. 13 is an illustration of a mounting process and demounting of the residual developer container relative to the image forming unit.

Figure 14A:
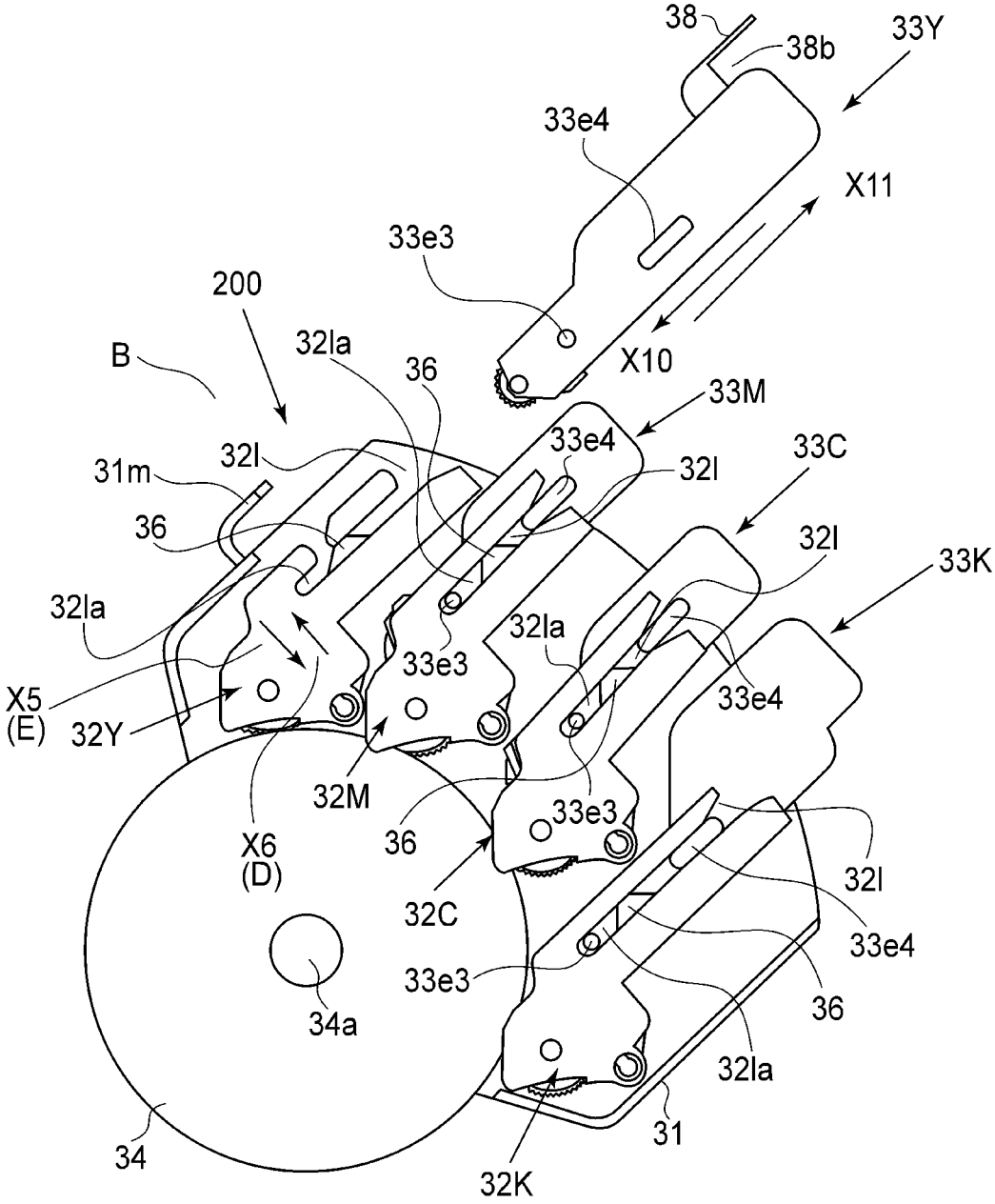
Figure 14B:
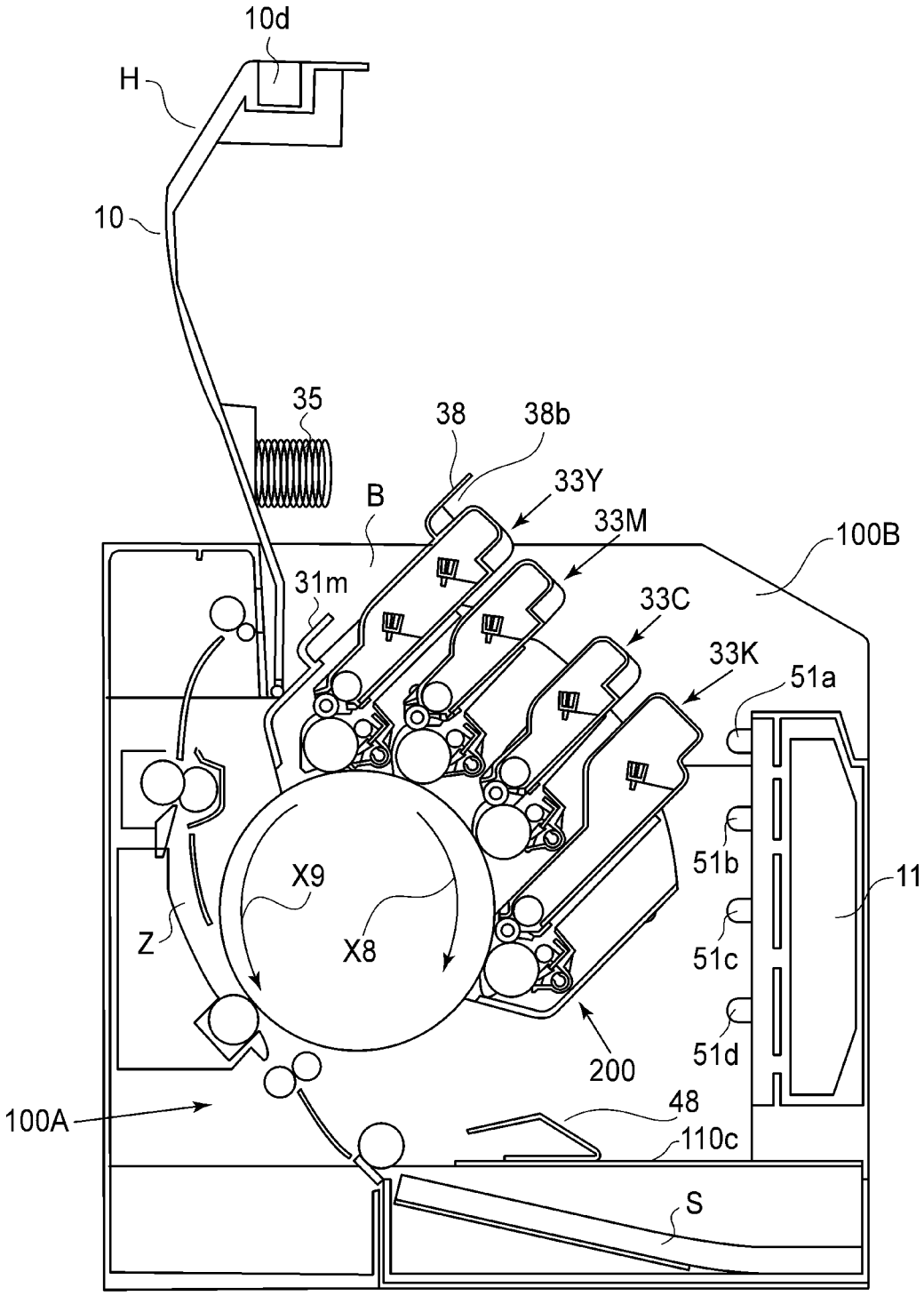

FIG. 14A is an illustration of the mounting and demounting process of the cartridge relative to the image forming unit, and FIG. 14B is an illustration of the mounting and demounting process of the cartridge relative to the image forming unit.

Figure 15A:
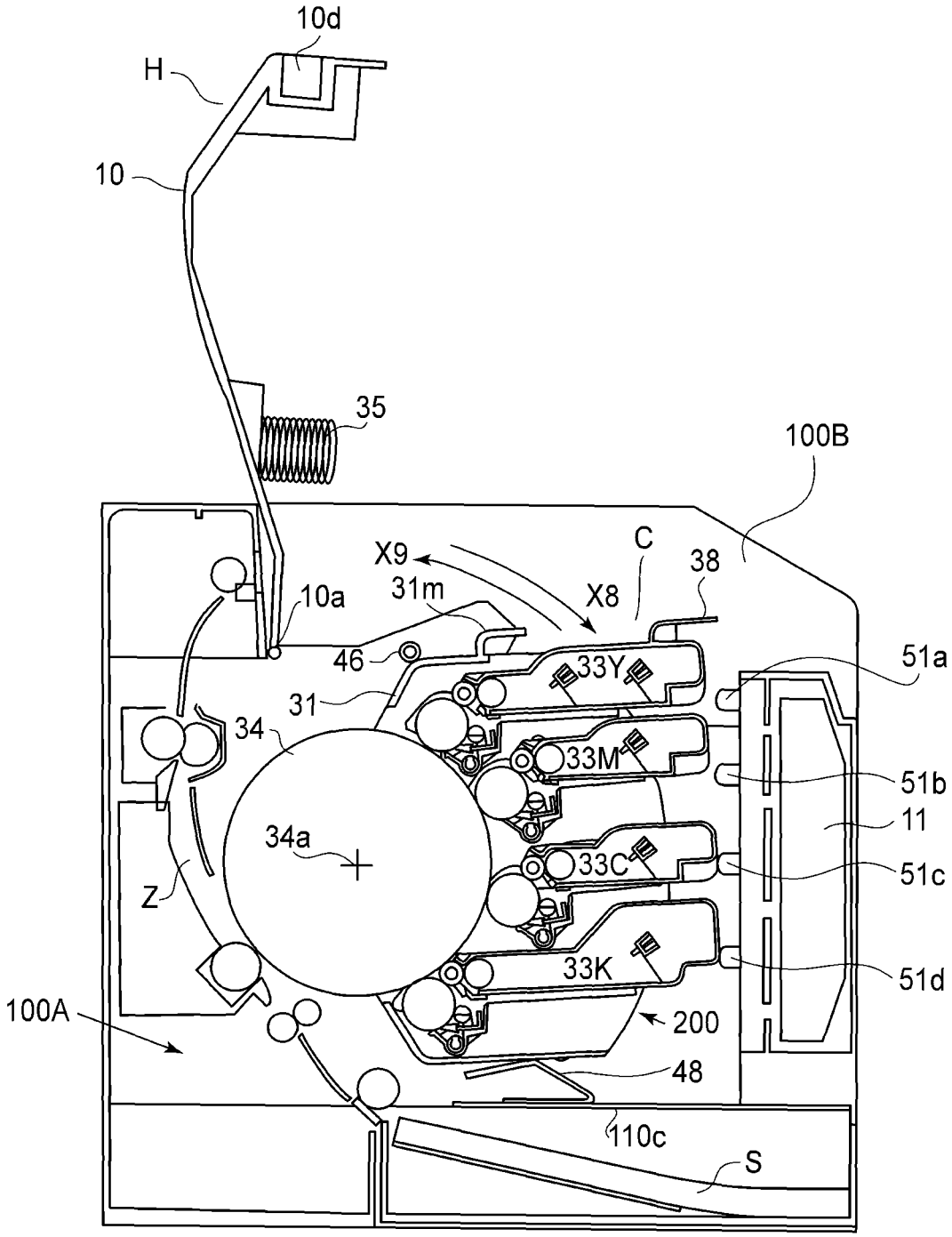
Figure 15B:
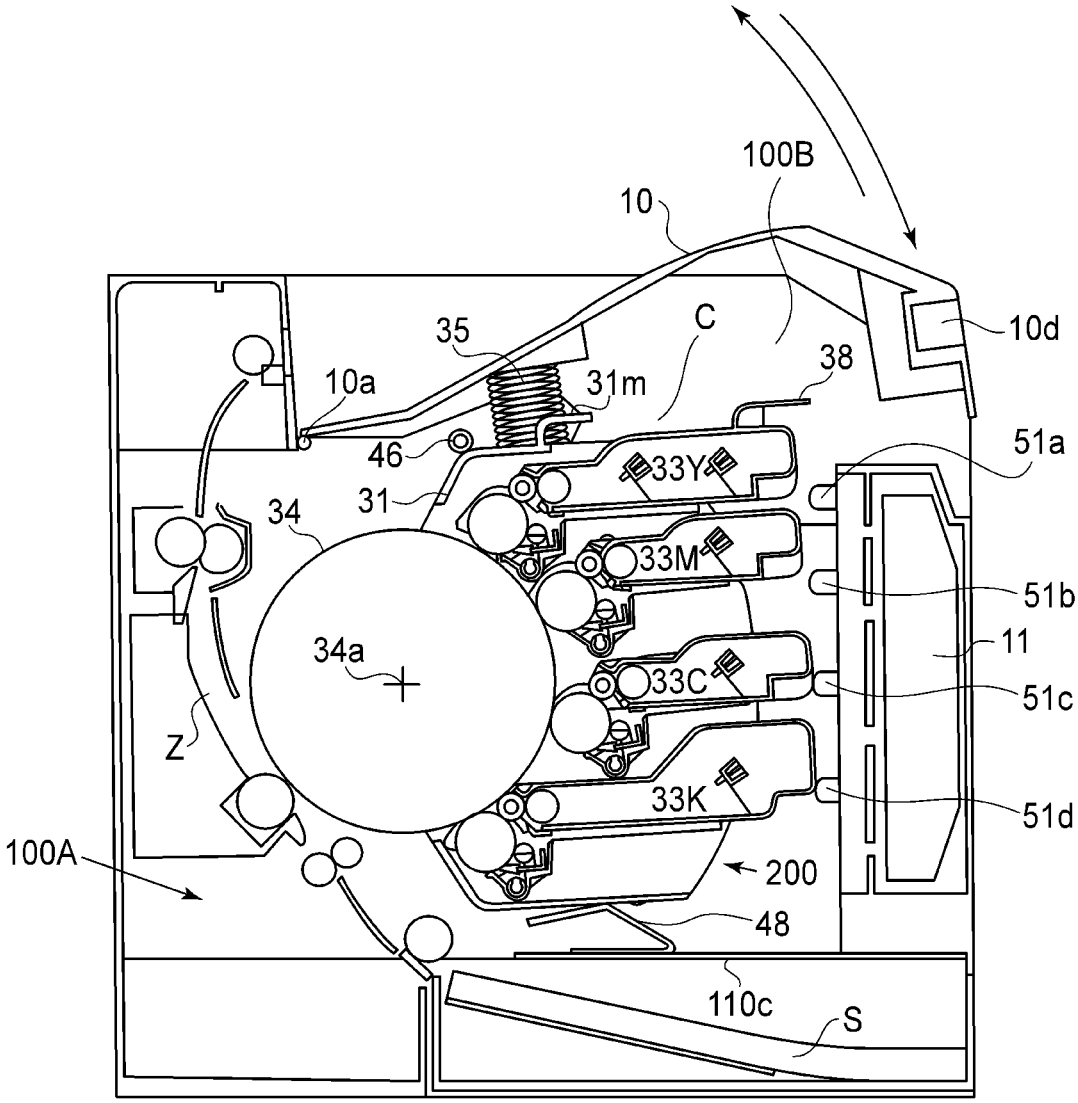

FIG. 15A is an illustration of the mounting and demounting process of the cartridge relative to the image forming unit, and FIG. 15B is an illustration of the mounting and demounting process of the cartridge relative to the image forming unit.

Figure 16A:
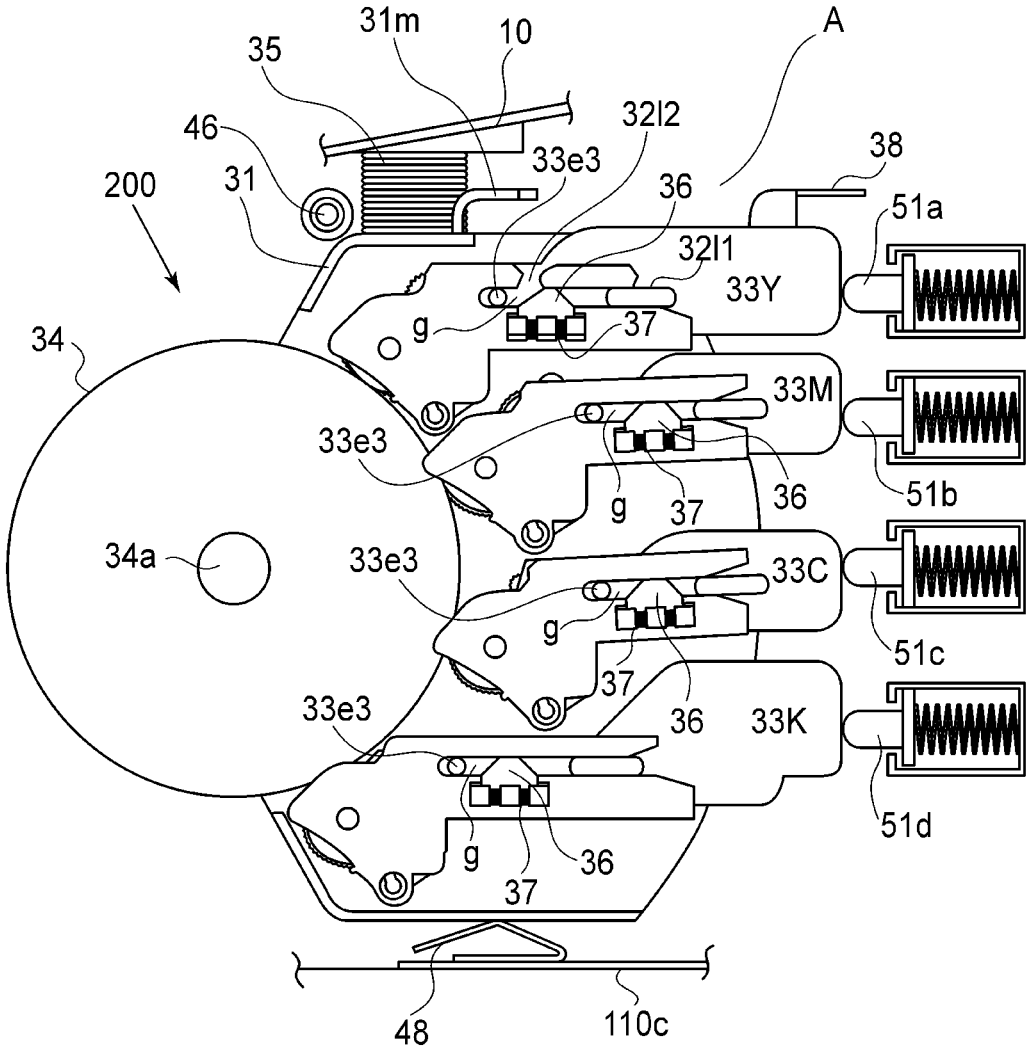
Figure 16B:
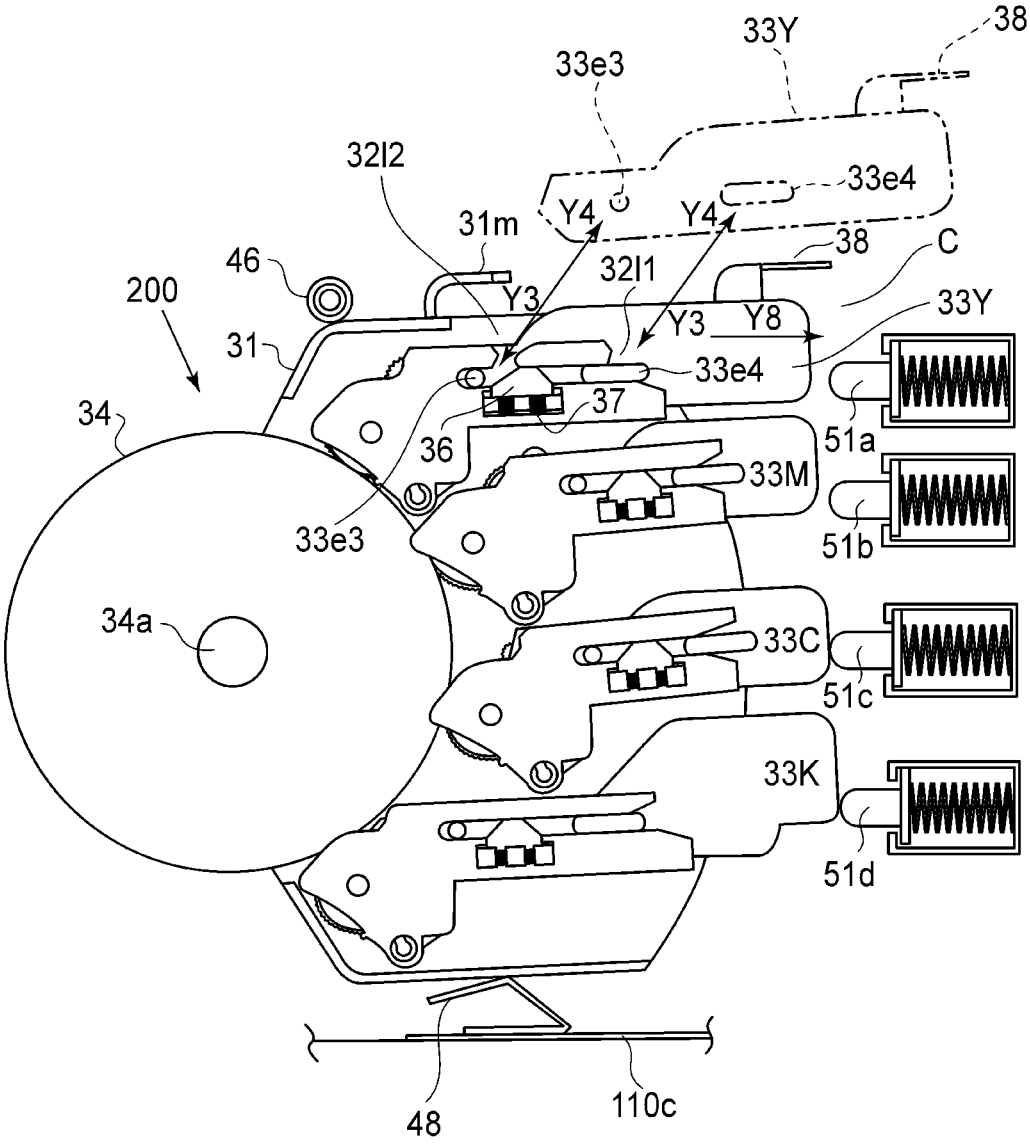

FIG. 16A is an illustration of the mounting and demounting process of the cartridge relative to the image forming unit, and FIG. 16B is an illustration of the mounting and demounting process of the cartridge relative to the image forming unit.

Figure 17:
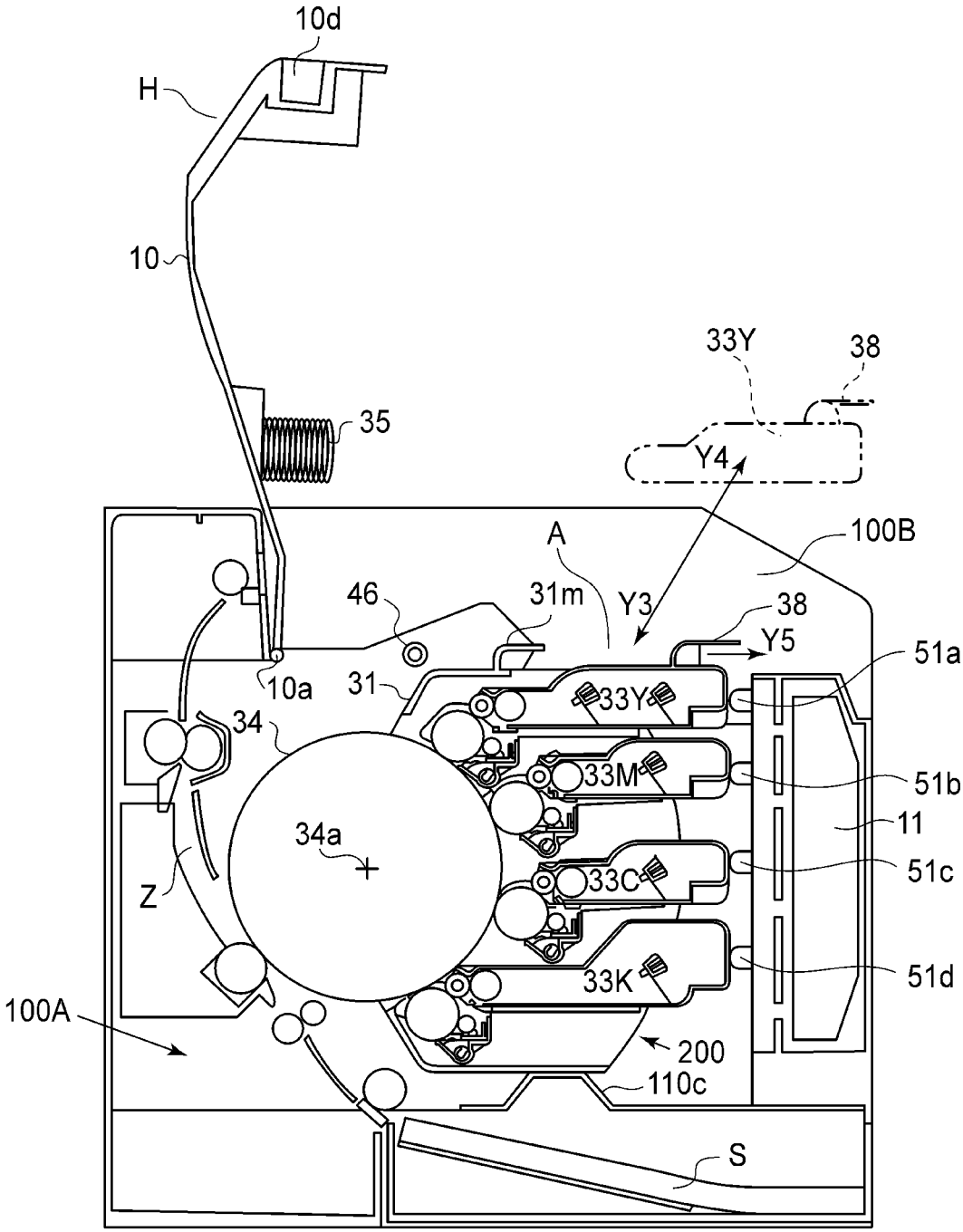

FIG. 17 is an illustration of the mounting and demounting process of the cartridge relative to the unit.

Figure 18:
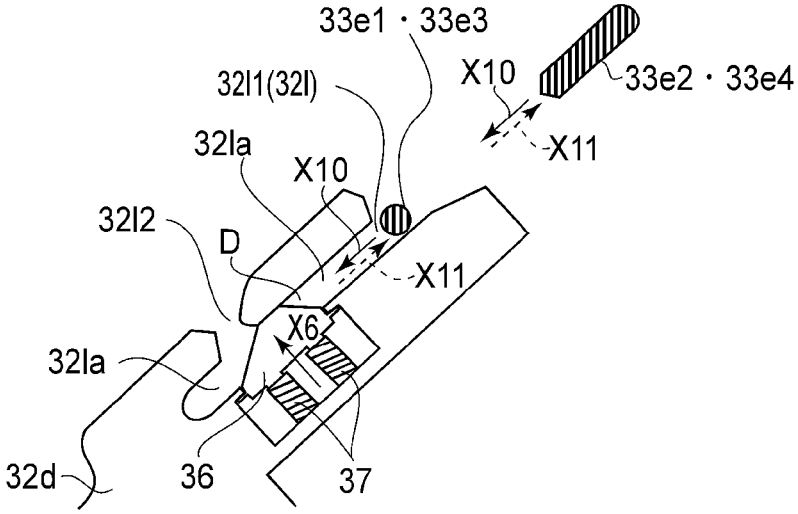
Figure 18:
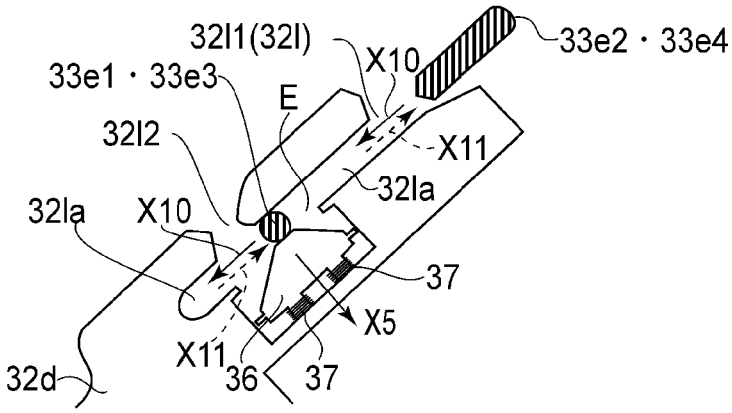
Figure 18:
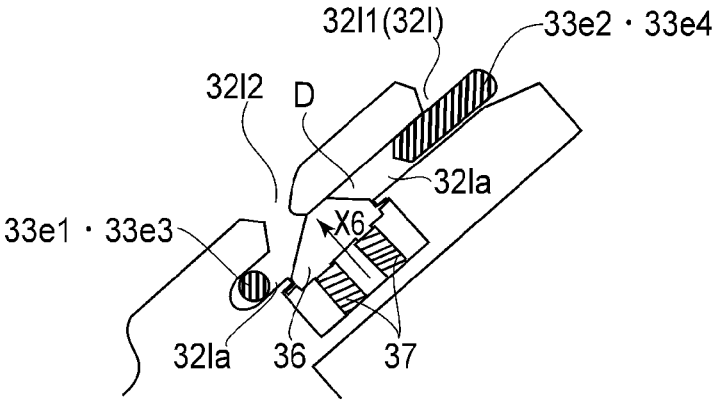

FIG. 18 is an illustration of the mounting and demounting process of the cartridge relative to the unit.

Figure 19:
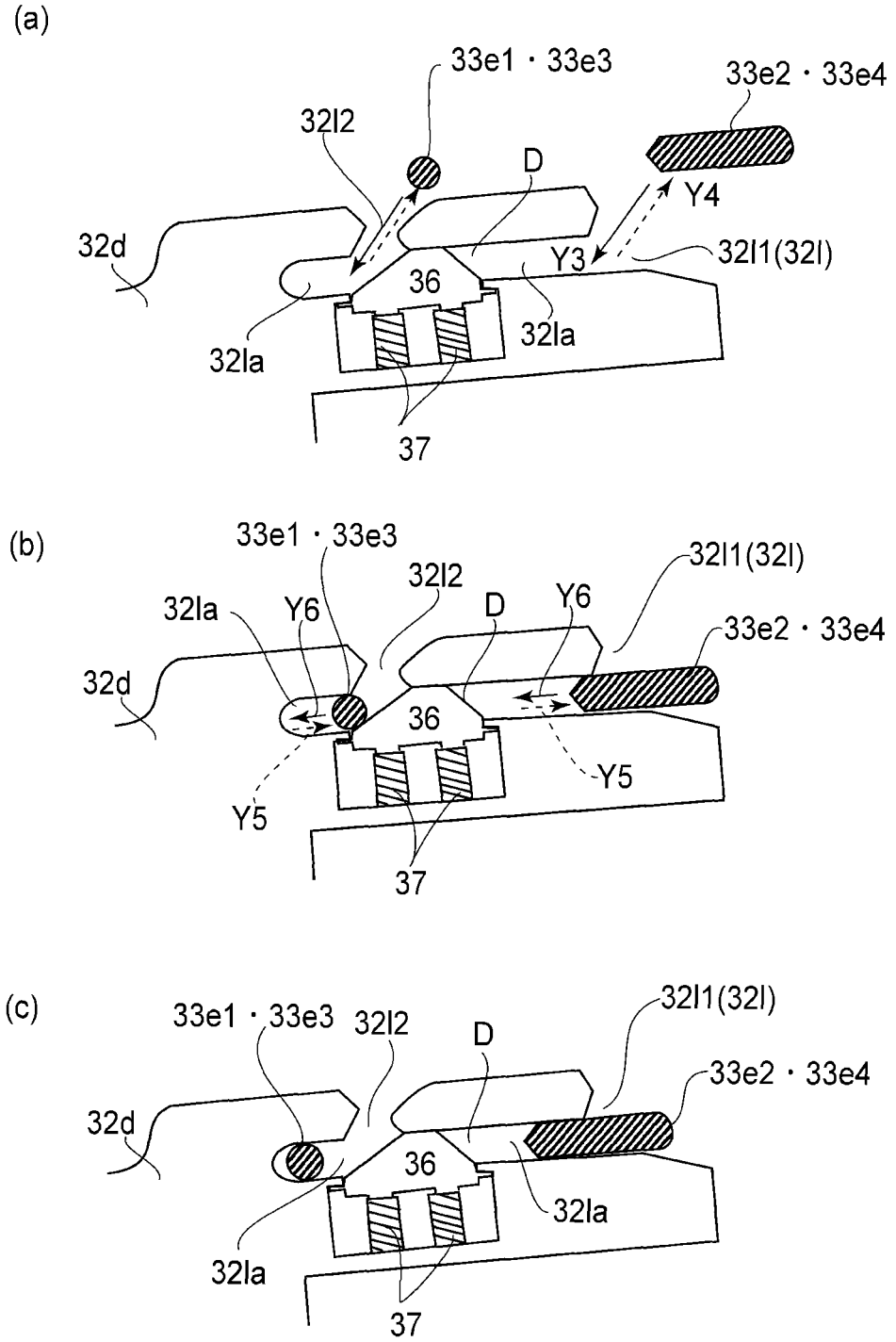

FIG. 19 is an illustration of the mounting and demounting process of the cartridge relative to the image forming unit.

Figure 20A:
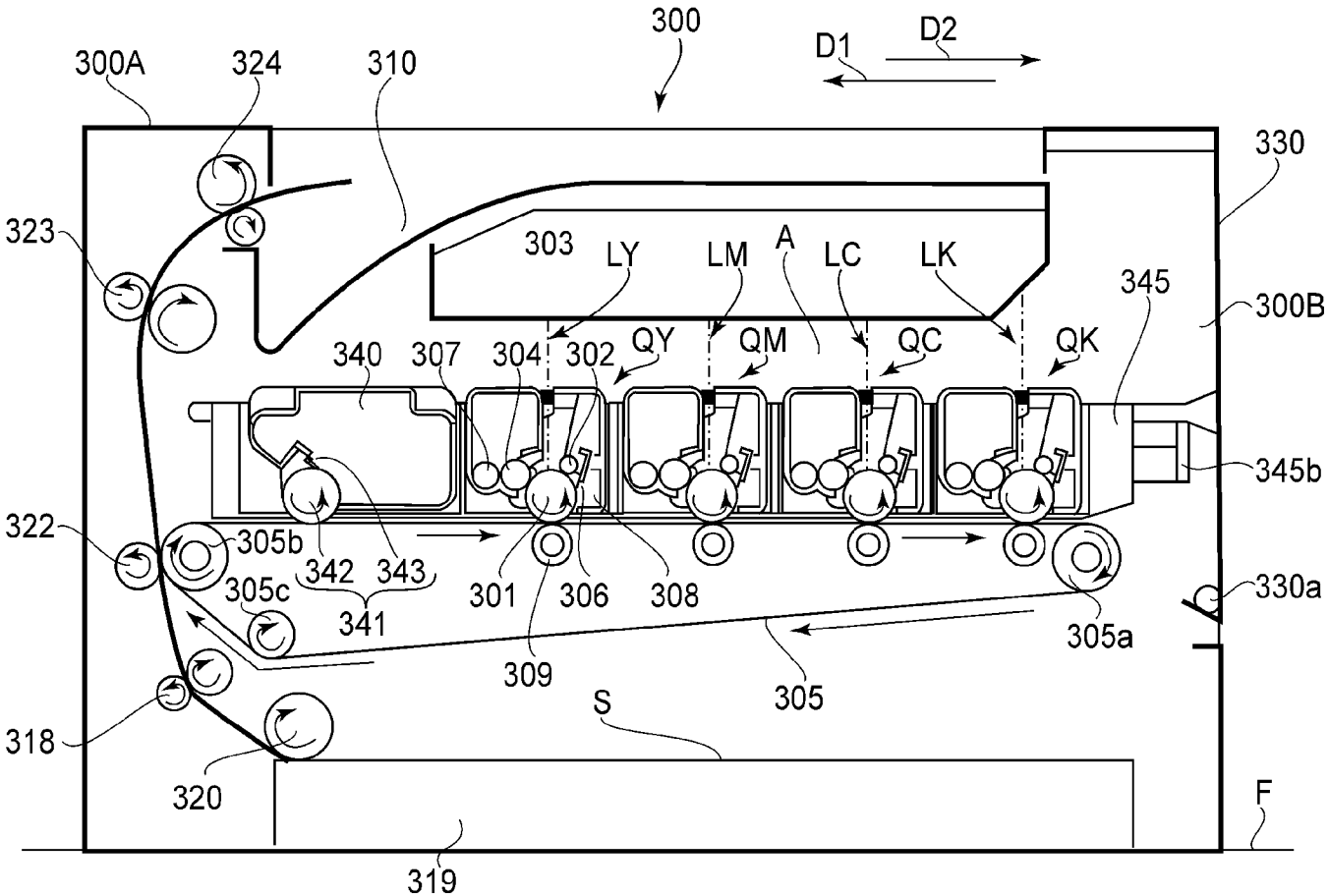
Figure 20B:
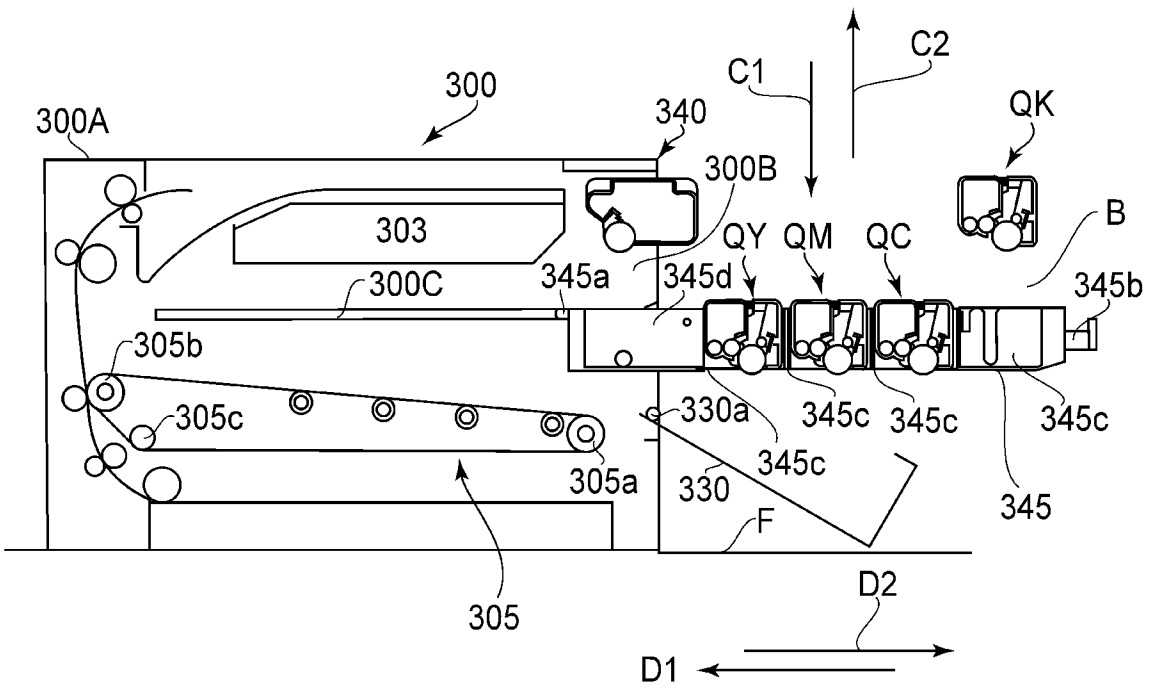

FIG. 20A is a vertical section left side view of the image forming apparatus according to Embodiment 2, and FIG. 20B is an illustration of the mounting and demounting process of the cartridge and the residual developer container.

Figure 21:
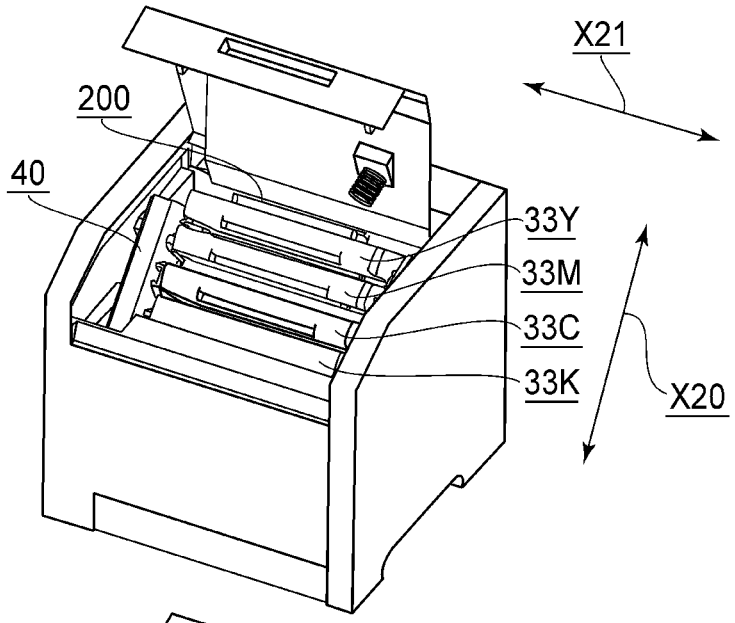
Figure 21:
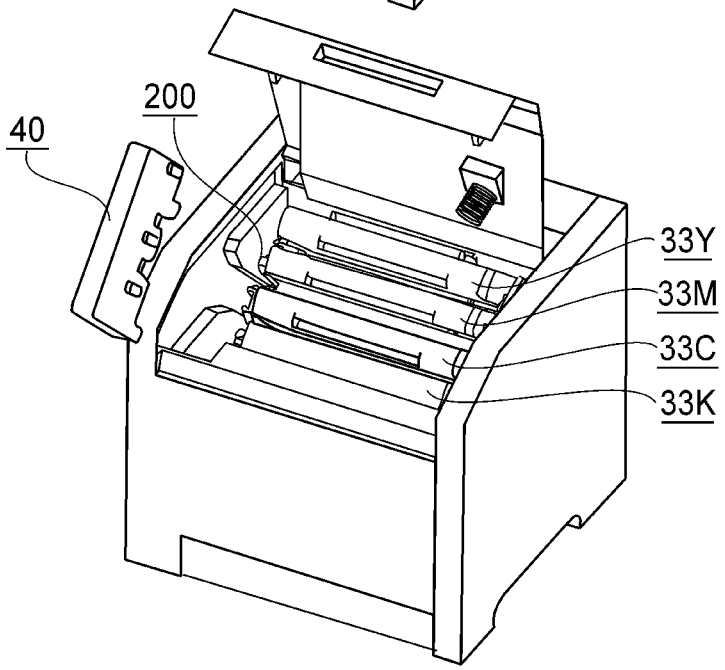

Part (a) of FIG. 21 is a perspective view illustrating the state that the container is mounted to a unit and (b) is a perspective view illustrating the state that the container is taken out of the unit.

Figure 22:
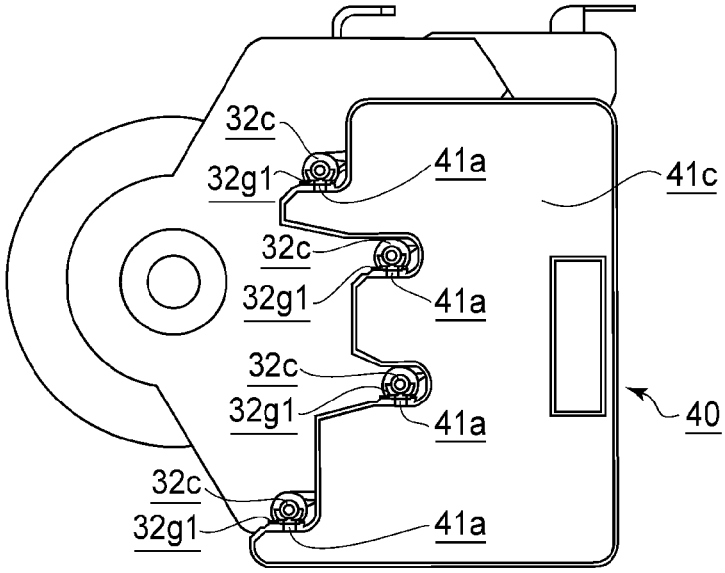
Figure 22:
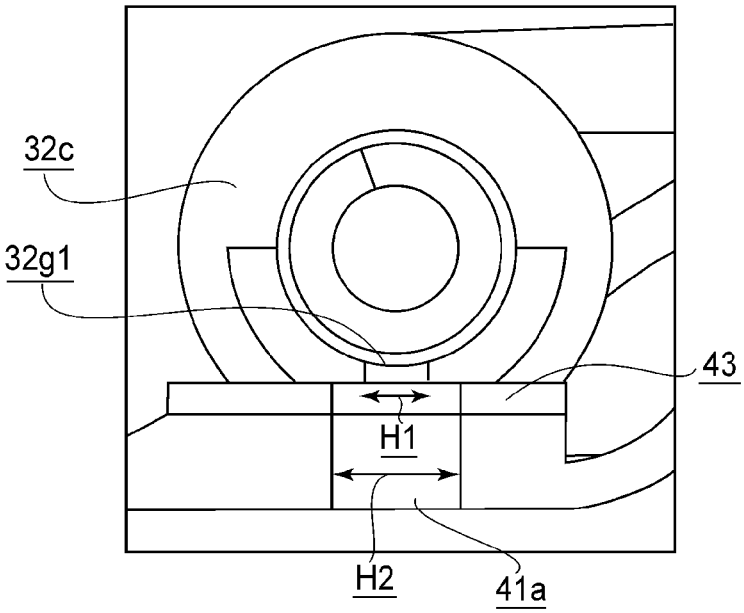

FIG. 22 is a view (sectional view) which shows the state that a reception side opening and a supply side opening is in engagement with each other, wherein (a) is a general arrangement, and (b) is a detailed view.

DESCRIPTION OF THE PREFERRED EMBODIMENT

The preferred embodiments of the present invention will be described in conjunction with the accompanying drawings. The dimensions, the materials, the configurations, the relative positions, and so on of the constituent parts which will be described hereinafter maybe properly changed by one skilled in the art depending on the structures and the various conditions of a device to which this invention is applied, and the scope of this invention is not limited to specific dimensions, materials, configurations, relative positions and so on of the embodiments which will be described below.

Embodiment 1

(General Arrangement of Color Electrophotographic Image Forming Apparatus)

Figure 1A:
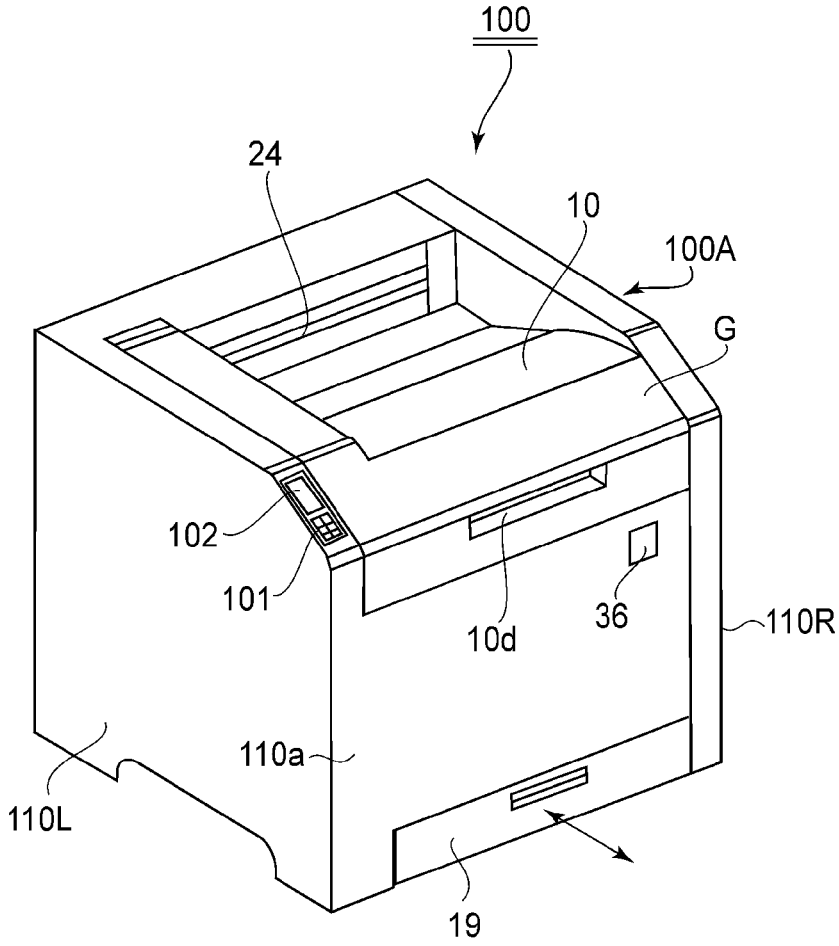
FIG. 1A is an outer appearance perspective view of an image forming apparatus of Embodiment 1.
Figure 1B:
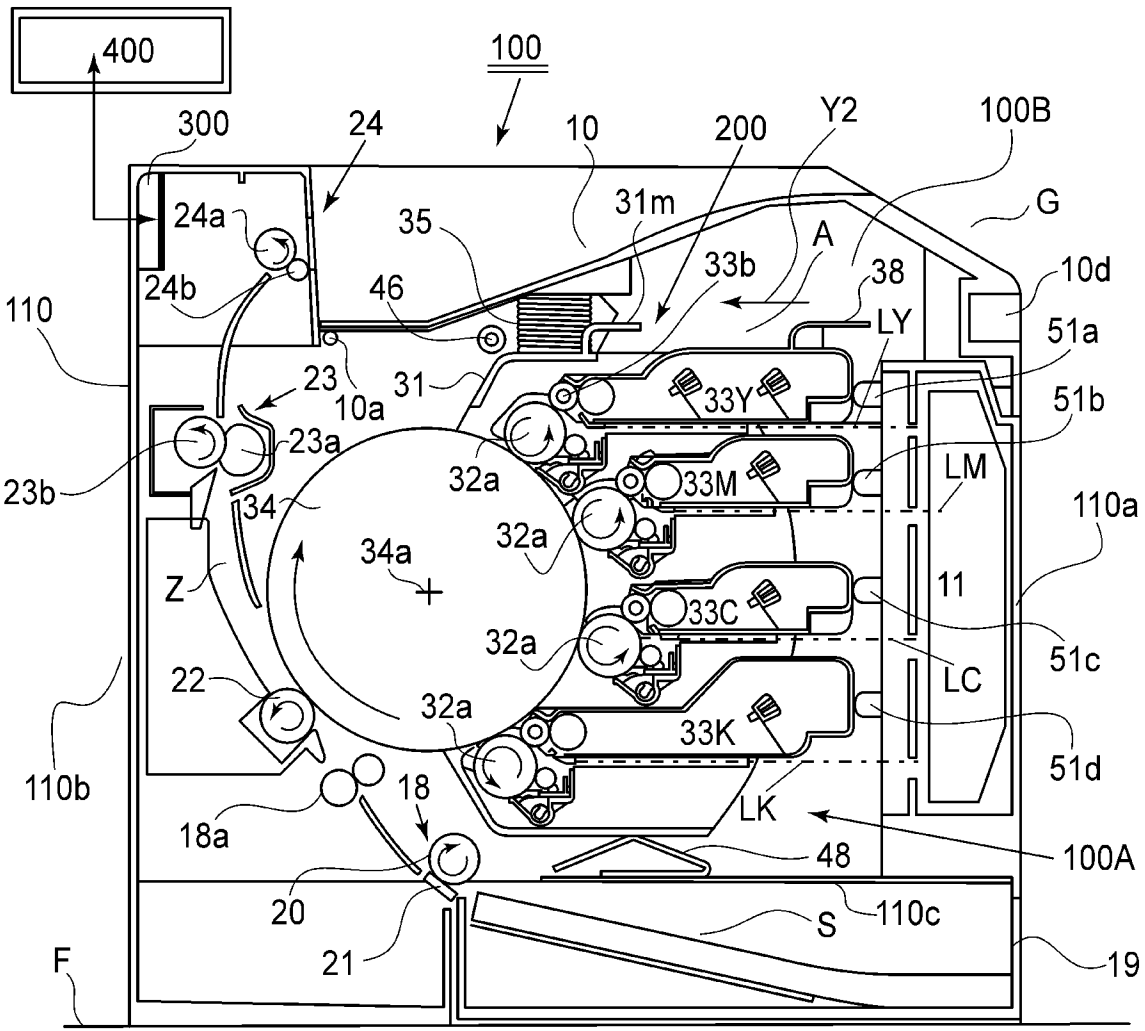
FIG. 1B is a left sectional view of the image forming apparatus.
Figure 2:
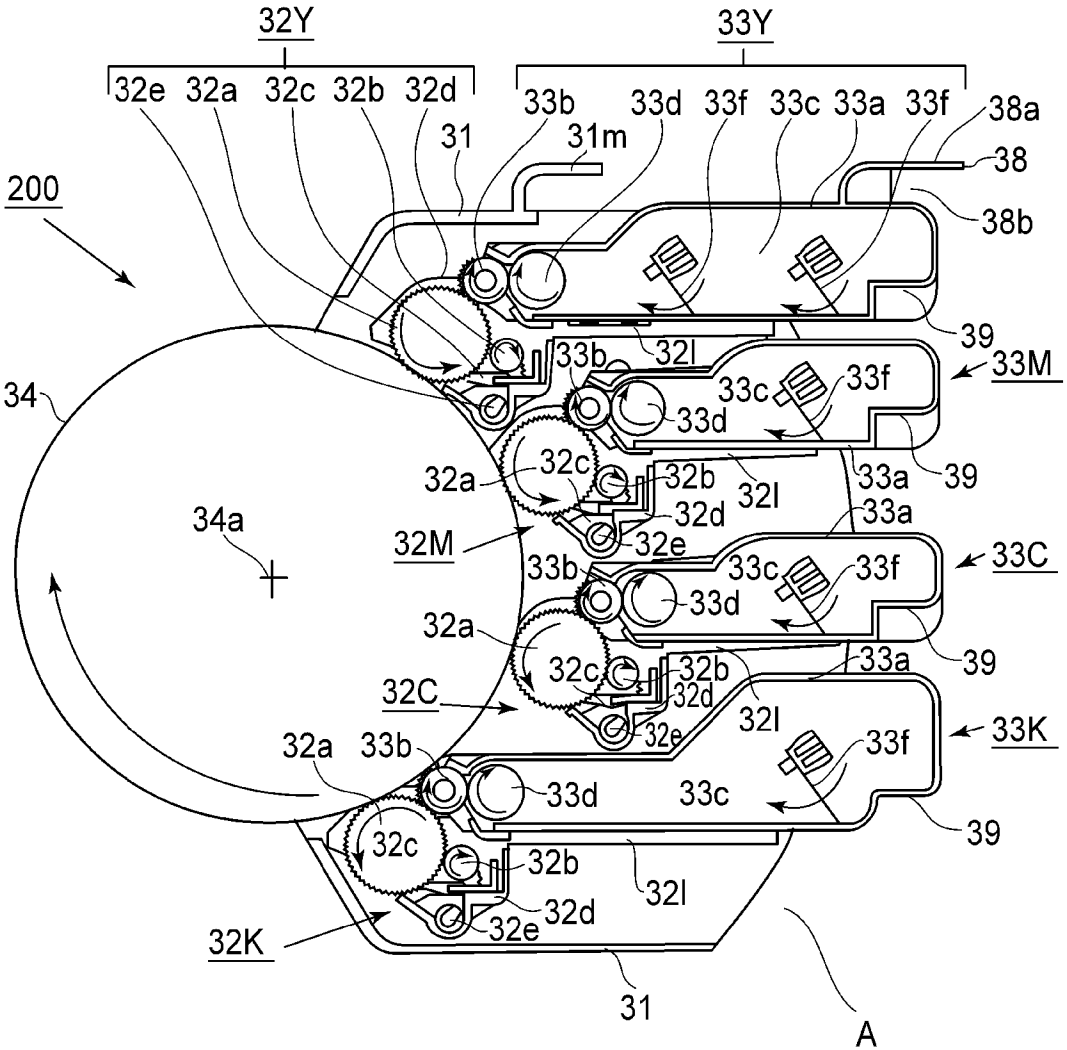
FIG. 2 is an enlarged view of an image forming unit shown in FIG. 1B.

FIG. 1A is an outer appearance perspective view of a color electrophotographic image forming apparatus (image forming apparatus or apparatus) 100 in this embodiment. FIG. 1B is a vertical section left side view of an image forming apparatus 100. The image forming apparatus 100 is a laser printer of a full-color (four color) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device. In the following descriptions, relating to the image forming apparatus 100 a front side is the side in which a feeding cassette 19 for stacking and accommodating recording materials S is drawn out of an inside of a main assembly 100A to an outside. A backside is the opposite side from it. An upper side is a side where a maintenance cover 10 is opened. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A longitudinal direction is a direction of an axis of an electrophotographic photosensitive drum or a developing roller. The main assembly 100A is portions of the image forming apparatus other than the cartridges 33 (Y, M, C and K) and an image forming unit 200 (supporting member). In the image forming apparatus 100 of this embodiment, a right-hand side is a driving side, and a left-hand side is the non-driving side. The image forming apparatus 100 is placed on a substantially horizontal installation surface F such as a mounting base, the desk or floor. A central portion in the main assembly 100A is provided with the image forming unit 200. FIG. 2 is an enlarged view of the image forming unit 200 shown in FIG. 1B. A unit 200 is provided with the cartridge mounting portion mounting guide 32*l* for dismountably mounting a plurality of cartridges In present embodiment, the first-fourth developing cartridges 33 (Y, M, C and K) and a single intermediary transfer member transfer member 34. In this embodiment, an electrophotographic photosensitive drum 32*a* corresponding to the cartridge 33 is mounted to the unit 200 as parts of a photosensitive member unit 32 (Y, M, C and K) with a charging roller 32*b* and a cleaning blade 32*c*. The charging roller 32*b* and the blade 32*c* are process means. In the device 100, the cartridges 33 are dismountably mounted to the main assembly 100A (unit 200), and a color image is formed on the recording material S. The unit 200 will be described in the detail hereinafter. In this embodiment, the cartridges 33 have the similar structures, other than the colors of contained developers (toner). However, they are not limited to this example. For example, a cartridge 33K which accommodates a black developer may be larger in the capacity of a developer accommodating portion than that of the cartridges 33 which accommodate the other color developers. In this embodiment, the cartridge is a developing cartridge, although the present invention is not limited to this. For example, the drum 32*a*, the charging roller 32*b*, and the cleaning blade 32*c* mounted to the unit 200 in this embodiment maybe mounted to the developing cartridge 33. In such a case, the cartridge is a process cartridge. The process cartridge contains the drum 32*a* and a charging roller 32*b*, a developing roller 33*b*, and a cleaning blade 32*c* as the process means integrally as a cartridge, and it is dismountably mounted as a unit to the main assembly 100A.

(Photosensitive Member Unit)

Each of the units 32 (Y, M, C and K) is fixed to a sub-frame 31 of the image forming unit 200. Each unit 32 includes the drum 32*a*. The unit 32 includes the charging roller 32*b* and the cleaning blade 32*c* for removing the developer which remained on the surface of the drum 32*a*, as the process means which acts on the drum 32*a*. A feeding screw (feeding member) 32*e* for feeding the developer removed by the blade 32*c* in the axial direction of the drum 32*a* is provided. The drum 32*a*, the charging roller 32*b*, the cleaning blade 32*c*, and the feeding screw 32*e* are disposed with a predetermined arrangement relation relative to a case 32*d*. FIG. 3A is a perspective view of a unit 32M, as seen from left-hand side. FIG. 3B is a perspective view of a photosensitive member case 32*d* excluding the drum 32*a*, the charging roller 32*b*, and the cleaning blade 32*c* from the unit 32M of FIG. 3A. Part (a) of FIG. 4 is a perspective view of the case 32*d* of (b) of FIG. 3, as seen from a right-hand side, and (b) is an enlarged vertical longitudinal sectional view of a removed developer discharging portion 32*f* of the case 32*d*. The other unit 32Y, 32C and 32K has substantially the same structures, and therefore, the description will be made as to the photosensitive member unit 32M. A right-hand end portion and a left-hand end portion of the case 32*d* are provided with the bearing portions 32*d*1 and 32*d* which comprise through-holes, respectively, which support the drum 32*a* rotatably. The insides of the bearing portions 32*d*1 or 32*d*2 are provided with the end sealing members 32*k*1, 32*k*2 contacting the drum 32*a* and the sheet-like sealing members 32*h* extended in the axial direction of the drum 32*a*. The each of the sealing members 32*k*1, 32*k*2 and 32*h* contacts to the surface of the drum 32*a*, so that the developer in the case 32*d* does not leak to an outside. An inside of the case 32*d* is provided with the feeding screw 32*e* extended in the longitudinal direction. The right-hand end portion of the screw 32*e* is provided with the feeding gear 32*i*, which receives a driving force from a drum gear 32*a*1 provided at the right-hand end portion of the drum 32*a* through an idler gear 32*j*. A removed developer in the case 32*d* is fed in the direction of the arrow X7 (leftward direction) by rotating operation of the screw 32*e*. The removed developer fed by the screw 32*e* is carried to the removed developer discharging portion 32*f* provided at the left-hand end portion of the screw 32*e*. The discharging portion 32*f* outwardly projects out of the left-hand end portion of the case 32*d*. The removed developer fed by the screw 32*e* is discharged to the outside through an opening 32*g*1 provided in the discharging portion 32*f*. The supply side opening 32*g*1 is provided with a rotatable shutter 32*g*. The shutter 32*g* is rotatable between an open position for opening the supply side opening 32*g*1 and a closing position for closing the opening 32*g*1. The shutter 32*g* is moved to the open position by the mounting operation, to the unit 200, of the residual developer container 40 (FIG. 12, FIG. 13) as will be described hereinafter. By this, the removed developer in the case 32*d* can be discharged to the inside of the container 40. When the container 40 is not mounted, the shutter 32*g* is urged to the closed position by a spring (unshown). In this manner, the developer does not leak out. The right-hand end portion and the left-hand end portion of each unit 32 is provided with the mounting portion 32*l* for mounting the cartridge 33, and the mounting portions 32*l* are extended in the direction perpendicular to the axes of the drums 32*a*, respectively. A part of a mounting portion 32*l* is provided with a recess 32*la* for receiving the portions-to-be-guided (portions-to-be-regulated) 33*e*1 and 33*e*3 (FIG. 5) of the cartridge 33. Adjacent the recess 32*la*, a regulating member 36 for regulating a position of the cartridge 33 and the urging member 37 for urging it are provided. As has been described hereinbefore, by providing the screw 32*e* for feeding the removed developer to the outside in each unit 32, it is not necessary to provide a space for containing the removed developer in the inside. Therefore, the unit 32 can be downsized. In this embodiment, the unit 32 is fixed to the unit 200. Therefore, when drum 32*a* or the like is worn, the whole unit 200 is exchanged. However, the unit 32 may be detachably mountable to the unit 200, and in such a case, only the unit 32 is exchanged.

As shown in FIG. 2, each of the cartridges 33 (Y, M, C and K) is provided with a case 33*a* and the developing roller 33*b* for developing the electrostatic latent image formed on the drum 32*a* into the developer image by supplying the developer to the drum 32*a*. The cartridge 33 is provided with the developer accommodating portion 33*c* for accommodating the developer to be used for a development of the electrostatic latent image and a supplying roller 33*d* for supplying the developer from the developer accommodating portion 33*c* to the roller 33*b*. The developer accommodating portion 33*c* is provided with the feeding member 33*f* for feeding the inner developer to the supplying roller 33*d*. A first cartridge 33Y accommodates the (yellow Y) color developer in the developer accommodating portion 33*c*, and a Y color developer image is formed on the surface of the corresponding drum 32*a*. A second cartridge 33M accommodates the (magenta M) color developer in the developer accommodating portion 33*c*, and a M color developer image is formed on the surface of the corresponding drum 32*a*. A third cartridge 33C accommodates the (cyan C) color developer in the developer accommodating portion 33*c*, and a C color developer image is formed on the surface of the corresponding drum 32*a*. A fourth cartridge 33K accommodates the (black K) color developer in the developer accommodating portion 33*c*, and a K color developer image is formed on the surface of the corresponding drum 32*a*. Part (a) of FIG. 5 is a perspective view of the cartridge 33Y, as seen from right-hand side, and (b) is a perspective view of that, as seen from left-hand side. The cartridges 33 will be described as to the case of this cartridge 33Y. The cartridge 33Y is mounted in the direction of the arrow X10 to the mounting portion 32*l* of the unit 200. The cartridge 33Y is dismounted from the mounting portion 32*l* of the unit 200 in the direction of the arrow X11 opposite to the arrow X10. The cartridge 33Y is provided with the developing roller 33*b* in a leading end with respect to the mounting direction. The right-hand end portion of the developing roller 33*b* is provided with a gear 50, which receives the driving force from the drum gear 32*a*1 to rotate the developing roller 33*b*. The gear 50 transmits the driving force to the supplying roller 33*d* and the feeding member 33*e* through a gear train (unshown). The each of the right-hand end portion and the left-hand end portion of the cartridge 33Y is provided with the portions-to-be-guided 33*e*1, 33*e*2, 33*e*3 and 33*e*4 for being guided by the unit 200, when the cartridge 33Y is mounted to the unit 200. The portion-to-be-guided 33*e*1 33*e*3 has a cylindrical shape and projects toward the outside of the right-hand end portion and the outside of the left-hand end portion of the cartridge 33Y. The portions-to-be-guided 33*e*2 and 33*e*4 have a substantially rectangular parallelepiped shape, and project toward the outside of the right-end portion and toward the outside of the left-end portion of the cartridge 33Y, and are extended in the direction perpendicular to the longitudinal direction of the cartridge 33. The portions-to-be-guided 33*e*1 and 33*e*3 are placed in a downstream side (with respect to the mounting direction X10 of cartridge 33Y) of the portions-to-be-guided 33*e*2, 33*e*4, respectively. On the cartridge 33Y side opposite from the roller (33*b*) side, a first grip 39 (FIG. 2) for griping the cartridge 33Y formed by recessing the bottom plate of the case 33*a* out is provided. The cartridge 33Y is provided at an upper portion with a first grip 38 for gripping the cartridge 33Y. While griping the grip 39 and the flat surface portion 38*a* of the grip 38, a user mounts and demounts the cartridge 33Y relative to the unit 200. While griping the grip 38, the user can mount and demount the cartridge 33Y relative to the unit 200. As has been described in the foregoing, the cartridge 33Y is provided with a first grip 39 and a second grip 38. The other cartridges PM, PC and PK have only the first grip 39. The user can mount and demount the other cartridges PM, PC and PK relative to the unit 200, while gripping the grip 39 and the top surface portion of the case 33*a*. In this embodiment, a transfer member 34 is rotatable about the substantially horizontal axis of the rotation axis 34*a*, and it is a cylindrical drum. Each cartridge 33 is provided on a front side of the transfer member 34, and extends substantially parallel with the installation surface F of the main assembly 100A they are provided adjacent to each other with respect to the substantially vertical direction. In the apparatus of this embodiment, the first cartridge 33Y takes the top most stage, and the second cartridge 33M is placed therebelow. The cartridge 33C is placed further below. The cartridge 33K takes the bottommost stage position. The roller 33*b* of each cartridge 33 may be in contact to the drum 32*a* (contact type developing system) or, it may be spaced with the predetermined small gap (predetermined distance) from the drum 32*a* (non-contact developing system).

(Scanner Unit)

Referring to FIG. 1, the front side (front part) of each cartridge 33 is provided with a laser scanner unit 11 as an image exposure device. The unit 11 is provided between a front frame 110*a* of a main frame 110 which is a frame of the main assembly 100A and each cartridge 33 in the main assembly 100A. The unit 11 includes a laser diode, a polygonal mirror, an Fθ lens, a reflection mirror, and so on. The unit 11 outputs laser beams L (Y, M, C and K) which are modulated correspondingly to the image information for the Y, M, C and K color inputted to the control circuit portion 300 from the external host device 400 to scan the drums 32*a* of the cartridges 33 for the corresponding colors (image exposure).

(Recording Material Feeding Mechanism)

A lower part of the unit 200 includes a feeding unit 18. The unit 18 includes a feeding cassette 19 for stacking recording material S, a feeding roller 20, a separation pad 21, and so on. A cassette 19 is inserted and detached at the front side of the main assembly 100A. In the main assembly 100A, between the transfer member 34 and a rear frame 110*b* of the main assembly 100A, there is provided a recording material feeding path Z extended from the feeding roller 20 to the upper rear portion in the main assembly 100A. A registration roller couple 18*a*, a secondary transfer roller 22, a fixing device 23, and a discharging roller pair 24 is provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a maintenance cover 10 which functions as a discharging tray for receiving a recording material S on which the image has been formed. The cover 10 opens and closes an opening 100B provided in the upper surface of the main assembly 100A (opening and closing member). As will be described hereinafter, the opening portion 100B is an opening for mounting and demounting the cartridge 33 relative to the unit 200 placed in mounting and dismounting position B ((b) of FIG. 10, and FIG. 14). FIG. 1B shows the state that the apparatus is capable of image forming operation 100. In this state, the cover 10 is placed in the closed position G for closing the opening portion 100B. The unit 200 is loaded with each cartridge 33, and is placed in an image forming position A for carrying out an image formation relative to the main assembly 100A. A gear (drive inputting portion) 34*b* (FIG. 6) of the transfer member 34 of the unit 200 is in engagement with a drive outputting portion (unshown) provided in the main assembly (100A) side. An electric power supply system (unshown) provided in the main assembly (100A) is electrically connected to an electrical contact (unshown) of each unit 32 and cartridge 33. Here, the driving system and the bias voltage application type described above can employ the structure similar to the case of the normal image forming apparatus, although not shown in the Figure for the sake of simplicity.

The operation for forming a full-color image will be described. Referring to (b) of FIG. 1, and FIG. 2, each drum 32*a* is rotationally driven in the counter-clockwise direction of the arrow at a predetermined speed. The charging roller 32*b* is rotated by the rotation of the drum 32*a*. The transfer member 34 is rotationally driven at the speed corresponding to the speed of the drum 32*a* in the clockwise direction (codirectional with the rotation of the drum 32*a*) of the arrow. The developing roller 33*b* and the supplying roller 33*d* are rotationally driven at the predetermined speeds in the clockwise directions of the arrows, respectively. The scanner unit 11 is driven. In synchronism with this drive, a predetermined charging bias voltage is applied to each charging roller 32*b* at predetermined control timing. By this, the surface of the drum 32*a* is uniformly charged by the charging roller 32*b* to the predetermined polarity and predetermined potential. The surface of each drum 32*a* is scanningly exposed to the laser beams L (Y, M, C and K) modulated in accordance with the color image signals corresponding to Y, M, C and K. By this, the electrostatic latent image corresponding to the correspondence color image signals is formed on the surface of the drum 32*a* of each cartridge P. The electrostatic latent image formed on the surface of each drum 32*a* is developed into the developer image by the developing roller 33*b* of the corresponding cartridge 33. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* opposed by a cartridge 33Y. The developer image is transferred (primary transfer) onto the transfer member 34 in a primary transfer nip which is the contact portion between the drum 32*a* and the intermediary transfer member 34. An M color developer image corresponding to a magenta component of the full-color image is formed on the drum 32*a* opposed by a cartridge 33M. The developer image is transferred (primary transfer)

onto the transfer member 34 in a primary transfer nip which is the contact portion between the drum 32*a* and the transfer member 34 superimposedly on the already transferred Y color developer image. A C color developer image corresponding to a cyan component of the full-color image is formed on the drum 32*a* opposed by a cartridge 33C. The developer image is transferred (primary transfer) onto the transfer member 34 in the primary transfer nip which is the contact portion between the drum 32*a* and the transfer member 34 superimposedly on the already transferred Y color +M color developer image. A K color developer image corresponding to a black component of the full-color image is formed on the drum 32*a* which the cartridge 33K opposed. The developer image is transferred (primary transfer) onto the transfer member 34 in the primary transfer nip which is the contact portion between the drum 32*a* and the transfer member 34 superimposedly on the already transferred Y color +M color +C color developer images. In this way, a full-color developer image of the Y color +M color +C color +K color is synthetically formed on the transfer member 34. An order of the colors of the developer images transferred is not limited to the above described order. In each drum 32*a*, the untransferred developer which remains on the drum surface after the primary transfer of the developer image is removed by a blade 32*c*, and is fed into the container 40 ((b) of FIG. 13) through the screw 32*e*. On the other hand, the feeding roller 20 is driven at the predetermined controlled timing. In this manner, by a cooperation of the feeding roller 20 and the separation pad 21, the separation and feeding of the sheet-like recording materials S stacked in the cassette 19 is carried out one by one. The recording material S is introduced into the secondary transfer nip which is the contact portion between the transfer member 34 and the secondary transfer roller 22, at the predetermined controlled timing by the registration roller couple 18*a*. The transfer roller 22 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 34 on which it is superimposed is sequentially transferred (secondary transfer) onto the surface of recording material S. The recording material S passed through the secondary transfer nip is separated from the surface of the transfer member 34 and is introduced into the fixing device 23 where it is heated and pressed by a fixing nip. By this, the color developer images are mixed and fixed on recording material S. The recording material S is discharged out of the fixing device 23, and is discharged on the cover 10 which functions as a discharging tray by discharging roller pair 24 as a full-color print. The toner remaining after the secondary transfer remaining on the surface of the transfer member 34 after the separation of the recording material S from the transfer member 34 is removed. In the case of this embodiment, the toner is electrostatically deposited onto the surface of the drum 32*a* in the primary transfer nip 34*b* in the unit 32Y between the drum 32*a* and the transfer member 34, and, and then it is removed by the cleaning blade 32*c*. The transfer member 34 is the rotatable member of a drum configuration. The different color developer images formed on the drums 32*a* is superimposedly transferred onto the transfer member 34. The developer images transferred superimposedly is transferred all together onto the recording material S from the transfer member 34. By this, the color image is formed on the recording material S. In the case where a monochromatic image is to be formed, the color developer image K formed on the drum 32*a* to which the cartridge 33K is opposed is transferred onto the transfer member 34. The transferred black developer image is transferred onto recording material S from the transfer member 34. By which a K color image is formed on the recording material S. In this embodiment, the secondary transfer roller 22 is movable between a first position in which it contacts to the transfer member 34 and forms the secondary transfer nip and a second position spaced from the transfer member 34 by a shifting mechanism (unshown). At the time of an image forming operation of the apparatus 100, the secondary transfer roller 22 is moved to the first position, and at the time of then on-image formation, it is moved to the second position. The transfer roller 22 may normally be contacted with the intermediary transfer member 34.

Referring to FIG. 6, the structure of the unit 200 will be described. Part (a) of FIG. 6 is a perspective view of the unit 200, as seen from left-hand side, and (b) is a perspective view, as seen from right-hand side. The unit 200 is provided with a sub-frame 31 detachably mountable relative to the main frame 110 of the main assembly 100A. The frame 31 supports the transfer member 34 which includes a cylindrical base member and an elastic member which coats the peripheral surface thereof rotatably. The transfer member 34 is rotatably supported at the left-hand end portion and the right-hand end portion of the center shaft (rotation shaft) 34*a* between a left side plate 31L and a right side plate 31R of the frame 31. A left shaft portion 45L and a right shaft portion 45R are fixed integrally to the outer surface of the side plates 31L, 31R co-axially with the center axis 34*a* of the transfer member 34. The right-hand end portion of the transfer member 34 is provided with the gear 34*b* for transmitting the driving force to each drum 32*a*, and transmits the driving force transmitted from a main assembly driving source (unshown) to a gear 32*a*1. About the transfer member 34, the units 32 32Y, (32M, 32C and 32K) are disposed, so that the drums 32*a* are contacted to the transfer member 34. Each of the unit 32 is positioned relative to the frame 31 by a positioning structure (unshown), and is fixed by screws or the like thereto. By this, the drum 32*a* and the transfer member 34 of each unit 32 can be positioned relative to each other with high precision. Each drum 32*a* is in contact to the transfer member 34 with a predetermined urging force. Each unit 32 is inserted and fixed in the direction of the arrow X1 relative to the frame 31. At this time, the discharging portion 32*f* provided at the left-hand end portion of each unit 32 is inserted into the frame 31 through the associated opening portion 31*k* provided in the left side plate 31L of the sub-frame 31. The discharging portion 32*f* is provided on the frame 31 in the state of projecting outwardly beyond the left side plate 31L. By providing the opening portion 31*k*, the discharging portion 32*f* which projects in the axial direction of the drum 32*a* can be mounted in the direction perpendicular to the axis of the drum 32*a*. The right side plate 31R of the frame 31 is provided with the portion-to-be-regulated 31*l* for regulating a rotation of the unit 200 in the main assembly 100A. The unit 200 is positioned in the main assembly 100A by the left shaft portion 45L, the right shaft portion 45R, and the portion-to-be-regulated 31*l*. The details thereof will be described hereinafter. The left shaft portion 45L, the right shaft portion 45R, and a portion-to-be-regulated-in-rotation 31*l*, which are the positioning portions for the transfer member 34 in the main assembly 100A is commonly provided on the frame 31, so that the position of the transfer member 34 in the main assembly 100A is determined with high precision. In order to rotate the unit 200 through a predetermined angle, a grip (second grip) 31*m* is provided in the upper portion of the frame 31. While griping the grip 31*m*, the user can rotate the unit 200 between the image forming position a ((b) of FIG. 1, and FIG.

2) for carrying out the image formation and the mounting and dismounting position B ((b) of FIG. 10, and FIG. 14) for mounting and demounting the cartridge 33. The right side plate 31R of the frame 31 is provided with a portion-to-be-regulated-in-rotation 31*n* for regulating the rotation position, when the unit 200 rotates or moves by a predetermined angle. The portion-to-be-regulated 31*n* engages with the regulating portion 46 (FIG. 7, FIG. 8) of the main assembly (100A) as will be described hereinafter to be regulated in this position. The portion-to-be-regulated 31*n* is a through-hole, and a cross-sectional configuration thereof is triangular (FIG. 8). The upper portion of the right side plate 31R extended to the portion-to-be-regulated 31*n* is provided with a guide portion 31*o* for guiding a rotation regulating portion 46 to guide the regulating portion 46 on the portions-to-be-regulated 32*n*. On the top plate 31C which connects the left side plate 31L and the right side plate 31R of the frame 31 with each other, a portion-to-be-urged 31*p* which is pressed by a unit urging spring 35 of the cover 10 as will be described hereinafter and which positions the unit 200 in the main assembly 100A is provided. As described above, each photosensitive member unit 32 fixed to the frame 31 is provided with a cartridge mounting portion 32*l* for dismountably mounting the cartridge 33. The mounting portion 32*l* for the cartridge 33Y is divided into a first mounting portion (mounting guide) 32*l*1 and second mounting portion (mounting guide) 32*l*2. The mounting portions 32*l*1 32*l*2 are constituted by the mounting portion 32*l* of the unit 32Y, the left side plate 31L, and the right side plate 31R. A function of each mounting portion will be described hereinafter.

(Image Forming Unit Mounting Portion)

As shown in FIG. 7, a left-hand side guiding plate 80L and a right-hand side guiding plate 80R are fixed opposed on the inside of a left-hand side frame 110L of the main assembly 100A and the inside of a right-hand side frame 110R. The each of the guiding plates 80L and 80R is provided with a positioning portion 80*a* for supporting the left and right shaft portions 45L and 45R of the frame 31 rotatably and a guide portion 80*b* for guiding the shaft portions 45L and 45R to the positioning portion 80*a*. The right-hand side guiding plate 80R is provided with a rotation regulating portion 80*c* which is continuous with the guide portion 80*b*, and the portion-to-be-regulated-in-rotation 31*l* provided on the unit 200 described above contacts to it to regulate the rotation of the unit 200. The upper portion of the right side guiding plate 80R is provided with the regulating portion 46 for regulating a rotational angle position of the unit 200 through the portion-to-be-regulated 31*n* of the unit 200, which is reciprocable. As shown in (a) of FIG. 8, a free end of the regulating portion 46 is provided with a tapered surface 46*a*. The regulating portion 46 is urged by the urging member toward main assembly 100A inwardly in the direction of the arrow Y0. The regulating portion 46 is provided with a flange portion 46*b*, which prevents a disengagement from the guiding plate 80R.

(Mounting of the Image Forming Unit)

The description will be made as to the mounting, into the main assembly 100A, of the unit 200. A rear side of the cover 10 is rotatably coupled through a hinge shaft 10*a* to the main assembly 100A. The cover 10 is movable between the closing position G for closing the opening portion 100B (FIG. 1B) of the top surface of the main assembly 100A and the open position H for opening the opening portion 100B (FIG. 7). The cover 10 is an opening and closing member for opening and closing the opening 100B in the upper portion of the main assembly 100A about the shaft 10*a*. The closed state (closing position) of the cover 10 is maintained by the engagement (latch engagement) between a locking claw portion 36*a* provided on a maintenance button (36) provided on a front side of the main assembly 100A and the locking claw portion 10*b* provided on the cover 10, as shown in (a) of FIG. 9. The locking claw portion 36*a* is the main assembly side locking portion, and the locking claw portion 10*b* is an opening and closing member side locking portion. The closure releasing of the cover 10 is carried out by pushing a button 36. When the button 36 is pushed rearwardly against the return spring (unshown), a claw portion 36*a* on the side of the button (36) escapes from a locking claw portion 10*b* of the cover 10 rearwardly, as shown by a chain line, so that the latching engagement is released. By this, the cover 10 is rotated to the open position H about the shaft 10*a* to open the opening portion 100B greatly. In this embodiment, the locking claw portion 36*a* and the locking claw portion 10*b* are elastically locked with each other releasably. However, this embodiment is not limited to this example. For example, the claw (locking portion) provided on one side maybe elastically and releasably locked with the hole (locking portion) provided in another side. As shown in (a) of FIG. 10, for the mounting of the unit 200 into the main assembly 100A, the user rotates the cover 10 to the open position H to greatly open the opening portion 100B. The user inserts the unit 200 into the main assembly 100A from the opening portion 100B. The left and right shaft portions 45L, 45R of the unit 200 is engaged with the guide portions 80*b* opposed to the left and right guiding plates 80L, 80R of the main assembly (100A), and the unit 200 is mounted into the main assembly 100A. Thereafter, the shaft portions 45L, 45R are contacted to the positioning portion 80*a* provided on an extension of the guide portion 80*b* ((b) of FIG. 10). At this time, the gear 34*b* (FIG. 6) provided at the one-end portion of the transfer member 34 engages with a driving gear (unshown) provided in the main assembly 100A. Thereafter, the user rotates the unit 200 in the direction of the arrow X2 shown in (a) of FIG. 11, while griping the grip 31*m*. The lower portion of the main assembly, 100A with respect to the direction of the arrow X2 is provided with a spring 48 on the top surface of a lower stay 110*c* of the main frame 110. When the unit 200 rotates, a spring member 48 is contacted to a lower surface of the frame 31 of the unit 200, and eases an impact caused by a rotational operation of the unit 200. The unit 200 rotated in the direction of the arrow X2 is stopped, in the state that it is urged upwardly by the spring member 48. Thereafter, the cover 10 is rotated to the closing position G to complete the mounting of the unit 200 into the main assembly 100A. More particularly, the unit 200 is rotatable about the shaft portions 45L and 45R, i.e., a rotational center 34*a* of the transfer member 34, between the left and right guiding plates 80L and 80R in the main assembly 100A. By this, the unit 200 is movable between the image forming position A (FIG. 1A and FIG. 2) for carrying out the image forming operation and the mounting and dismounting position B for mounting and demounting the cartridge 33 ((b) of FIG. 10). This will be described hereinafter.

(Residual Developer Container)

FIG. 11B is a right-hand side perspective view of the residual developer container 40, (a) of FIG. 12 is a left-hand side perspective view, and (b) is a sectional view taken along a line (12)-(12) of FIG. 11B. As has been described in the foregoing, in each unit 32 (Y, M, C and K), the developer which remains on the surface of the drum 32*a* is removed by a blade (cleaning member) 32*c*, and thereafter, it is fed by a screw (feeding member) 32*e* in the feeding direction. The fed residual developer is contained in the container, 40 provided at the left-hand end portion of the unit 200 which is in the downstream side with respect to the feeding direction of the screw 32*e*. The container 40 comprises an accommodating container 41 and a cover 42, which are unified by the welding and so on. The accommodating container 41 is provided with a residual developer receiving opening 41*a* corresponding to the unit 32. As shown in FIG. 2, in this embodiment, a plurality of drums 32*a* are disposed with the gaps along the peripheral surface of the transfer member 34. The reception side openings (openings) 41*a* are correspondingly disposed with the deviation (FIG. 12 (*a*) s). Each opening 41*a* is placed in the recess 41*b* provided in the accommodating container 41 and the recess 41*b* has sufficient size permitting the passage of the discharging portion 32*f* of the unit 32. The circumference of each opening 41*a* is provided with a sealing member 43 for preventing the developer from outwardly scattering by contacting the discharging portion 32*f*. The sealing member 43 is fixed by double coated tape or the like to the accommodating container 41. The sealing member 43 is provided with the opening having substantially the same size as that of the opening 41*a*. An accommodating portion 41*c* is provided below the opening 41*a*, and it contains the residual developer received through the opening 41*a*. In more detail, the accommodating portions 41*c* are connected with each other inside in order to accumulate the residual developers supplied from the openings 41*a* together. Therefore, a space efficiency is good, as compared with the case in which the accommodating portions are provided for the respective opening portions. A right side of the accommodating container 41 is provided with a portion-to-be-guided 41*d*-41*f* for facilitating mounting the container 40 to the unit 200. The container 40 is mounted and positioned to the unit 200 through the portions-to-be-guided 41*d*-41*f*. The cover 42 is provided with the grip 42*a* for mounting and demounting the container 40 relative to the unit 200. The grip 42*a* is provided by forming the recess in the cover 42. When an amount of the residual developer more than a predetermined amount is contained in the container 40, the user grips the grip 42*a* and dismounts the container 40 from the unit 200 to exchange it with a new container. Or, after the residual developer in the container 40 is discarded, the container 40 thereof may be re-used.

(Mounting, to Image Forming Unit, of Residual Developer Container)

The container 40 is mounted and demounted in the direction (the direction perpendicular to the axis of the drum 32*a*) of the arrow X3 in the state that the unit 200 is placed in the mounting and dismounting position B ((b) of FIG. 10). As shown in (a) of FIG. 6, or (a) of FIG. 13, the outside surface of the left side plate 31L of the frame 31 is provided with guide portions 31*m*1-31*m*3. The portions-to-be-guided 41*d*-41*f* provided in the container 40 is inserted in the direction of the arrow X3 into the guide portions 31*m* (1-3), respectively. In the guide portion 31*m*2, the urging member 49 in the form of the leaf spring is provided, and the portion-to-be-guided 41*e* is urged in the arrow X4 after receiving the portion-to-be-guided 41*e*. By urging to the urging member 49, the portion-to-be-guided 41*e* contacts the portion to be positioned (FIG. 11B) 41*e*1 thereof to a positioning portion 31*m*4 provided at a trailing end of a guide portion 31*m*2 to accomplish positioning in the front-rear direction. The width (up-down direction) of the portion-to-be-guided 41*e* is substantially the same as that of the width (up-down direction) of the guide portion 31*m*2, and therefore, the positioning in the up-down direction is simultaneously carried out. Furthermore, the urging member 49 regulates the movement in the direction opposite the direction of the arrow X3, and therefore, disengagement is prevented, during the rotational operation of the unit 200. Here, the urging member 49 functions as a locking portion 49 of the container 40 relative to the unit 200, and the guide portion 31*m*2 functions as the portion-to-be-locked 31*m*2 locked with the locking member 49. As has been described in the foregoing, the container 40 is mounted and demounted relative to the unit 200 ((b) of FIG. 13). By a series of mounting operations, the shutter 32*g* provided in each unit 32 is moved to the open position by an actuator (unshown). When the mounting is completed, a reception side opening 41*a* provided in the container 40 opposes to the supplying side opening 32*g*1 provided in the unit 32, and can receive the residual developer fed by the screw 32*e*. FIG. 22 is a sectional view illustrating the state that the opening 41*a* and an opening 32*g*1 are in engagement with each other. Part (a) of FIG. 22 is a general arrangement, and (b) of FIG. 22 is a detailed view. The size H2 of the opening 41*a* is larger than the size H1 of the opening 32*g*1. By this, even if the difference of the position between the opening 41*a* and the opening 32*g*1 varies due to the individual difference, the opening 32*g*1 can overlap the opening 41*a* assuredly, and the supplied residual developer does not outwardly leak. In this embodiment, the openings 41*a* is deviated due to the disposition of the drum 32*a*, and therefore, the positional accuracy between the openings tends to deteriorate. As has been described in the foregoing, the size H2 of the opening 41*a* is larger than the size H1 of the opening 32*g*1, and therefore, the variation in the positional accuracy is accommodated to collect the residual developer assuredly. It is preferable to change a difference between H1 and H2 in accordance with the settings (tolerances) of respective types. Part (a) of FIG. 21 is a perspective view illustrating the state that the container 40 is mounted to the unit 200, and part (b) of FIG. 21 is a perspective view illustrating the state that the container 40 is taken out of the unit 200. The container 40 is provided adjacent to each other along the direction (arrow X20) in which a plurality of cartridges 33 33Y, (33M, 33C, 33K) are arranged adjacent to each other. In more detail, as shown in (b) of FIG. 13, the container 40 is provided over the cartridges 33 so that parts of the containers 40 may overlap with the cartridge 33, as seen in the axial direction of the drum 32*a*. Therefore, the container 40 can be provided in the form with which the enlargement of the space in the direction of the arrow X21 perpendicular to the direction of the arrow X20 is suppressed as much as possible. In more detail, the cartridges 33 are arranged adjacent to each other unidirectionally, and the container 40 is extended along the one direction. In exchanging the container 40, as described above, while the user grips the grip 42*a*, the user dismounts the container 40 from the unit 200. In the state where the unit 200 is placed in the mounting and dismounting position B, the container 40 can be exchanged in the same position as the mounting and dismounting position B of the cartridge 33 as will be described hereinafter. In response to the operation which dismounts the container 40, an opening of the unit 32 is shut by a spring member of the shutter 32*g*. On the other hand, the member such as a shutter is not provided for the opening 41*a* of the container 40 in order to suppress a cost. However, in the movement in a mounting and demounting direction (direction of arrow X3 in (a) of FIG. 13, and the opposite direction thereto) of the container 40, the opening 41*a* does not face downwardly, and therefore, the leakage of the residual developer is sufficiently suppressed without a shutter and so on. The opening 41*a* always faces upwardly, when the unit 200 rotates from the mounting and dismounting position B to a before-mounting-demounting-position C, or, when it rotates to the image forming position A, also when it rotates in the opposite direction. The container 40 is provided with the opening for containing the developer removed by the cleaning member in the container, and the opening always faces upwardly at the time of the rotation of the unit 200. By this, the residual developer inside the container 40 can be suppressed from leaking outside. In this embodiment, the opening 41*a* is not be provided with the shutter and so on, but, even in the case where the shutter for opening and closing the opening 41*a* or the like is provided, the leakage of the residual developer to the outside can be minimized. The container 40 can be mounted and demounted relative to the unit 200, and therefore, the user can carry out the exchange of the cartridge 33 and the exchange of the container 40 through the same process, and therefore, the usability is improved. The mounting and demounting direction of the container 40 and the mounting and demounting direction of the cartridge 33 as will be described hereinafter are the same, and therefore, the user can carry out those operations easily. Here, the same direction is not in the strict sense, but the directions may slightly be deviated, if the mounting and demounting of the container 40 and the cartridge 33 can be performed, without changing the position of the unit 200. Furthermore, the container 40 and the cartridge 33 can be mounted and demounted individually. They are disposed so as n not to overlap as seen in the mounting and demounting direction (the direction of the arrow X3 of FIG. 10 (*b*)). The guide portion 31*m* (1-3) of the unit 200 for mounting the container 40 is provided on the outside surface of the sub-frame 31. Therefore, it is not necessary to provide the accommodating space for accommodating the container 40 in the frame 31, and therefore, the downsizing of a device can be accomplished. The mounting position for the container, 40 is provided in the non-driving side which is the side opposite from the driving side which is provided with the driving system (driving force transmitting portion) of the drum gear 32*a*1 and the feeding gear 32*f* or the like with respect to the axial direction of the drum 32*a*. Therefore, the latitude in the disposition of the driving system is enhanced, and as a result, the downsizing of the device is accomplished.

The mounting and demounting of the cartridges 33 (Y, M, C and K) relative to the unit 200 is carried out in the state that the unit 200 is placed in mounting and dismounting position B ((b) of FIG. 10). First, the cover 10 is moved to the open position which opens the opening portion 100B from the closing position which closes the opening portion 100B ((a) of FIG. 11). Then, while griping the grip 31*m* provided by the unit 200, the user rotates the unit 200 to the mounting and dismounting position B ((b) of FIG. 10). When the cover 10 is rotated by a predetermined angle by the above-described rotational operation, the regulating portion 46 provided on the main assembly 100A engages with the portion-to-be-regulated 31*n* provided on the frame 31. At this time, the unit 200 is regulated by the regulating portion 46 in the mounting and dismounting position B. In other words, the unit 200 is temporarily fixed in the mounting and dismounting position B, and the movement toward the image forming position A is regulated. Since the unit 200 is regulated in the mounting and dismounting position B, the user can carry out a mounting and dismounting operation of the cartridge 33, while keeping the hand off the grip 31*m*, and therefore, the usability is improved. At first, the user grips a first grip 39 (FIG. 2) provided on the cartridges 33 33M, (33C and 33K) and a part of developing device cases 33*a*. With respect to the cartridge 33Y, the user grips the grip 39 and the flat surface portion 38*a* (FIG. 5) of a grip 38. Or, only the grip 38 is griped. Each cartridge 33 is mounted to the corresponding mounting portion 32*l* of the unit 200. The mounting direction is the direction (mounting direction) perpendicular to a rotational axis direction of a developing roller 32*b*. More particularly, as shown in FIG. 14A, and (a) of FIG. 18, the portions-to-be-guided 33*e*1, 33*e*3 in the side of the cartridge (33) is inserted into the mounting portion 32*l* of a unit (200). FIG. 14A, and (a) of FIG. 18 show the case of the mounting of the cartridge 33Y. In the case of the mounting of the cartridge 33Y, it is inserted into a first mounting portion 32*l*1. Subsequently, the portions-to-be-guided 33*e*2, 33*e*4 is inserted. The portion-to-be-guided 33*e*1-33*e*4 is guided by the mounting portion 32*l*, and it is inserted into the inside toward the drum 32*a*. The portions-to-be-guided 33*e*1, 33*e*3 are abutted to the regulating member 36 provided in the mounting portion 32*l*. The regulating member 36 in this embodiment is an L-shape member, and the portions-to-be-guided 33*e*1, 33*e*3 are abutted to the L-shape portion. In the free state of the regulating member 36, the regulating member 36 is raised by the urging force of the urging member 37, so that an L-shape portion enters the recess 32*la* of the mounting portion 32*l*, and abuts to and is stopped by the upper surface 321*a* of the ceiling surface. The pushing-up position of the regulating member at this time 36 is a regulating position D. Furthermore, when the cartridge 33 is further inserted, the portions-to-be-guided 33*e*1, 33*e*3 apply the depression force against the urging force of the urging member 37 which urges the regulating member 36, the L-shaped portion of the regulating member 36 functioning as an inclined cam surface. By this, the regulating member 36 is pushed down in the arrow X5 away from the recess 32*la* of the mounting portion 32*l*, so that the portions-to-be-guided 33*e*1, 33*e*3 enter between the top surface of the regulating member 36 and the ceiling surface of the recess 32*la* ((b) of FIG. 18). The push down position of the regulating member at this time 36 is a permission position E, wherein the mounting and demounting of the cartridge 33 is permitted. In this manner, the portions-to-be-guided 33*e*1 and 33*e*3 enters a rear side of the recess 32*la* beyond the regulating member 36. The portions-to-be-guided 33*e*2 and 33*e*4 also enter the recess 32*la* of the mounting portion 32*l* ((c) of FIG. 18). By this, the mounting, into the unit 200, of the cartridge 33 is completed. When the portions-to-be-guided 33*e*1 and 33*e*3 pass, the regulating member 36 is again moved in the direction of the arrow X6 which is the direction opposite to the direction of the arrow X5 by the urging force of the urging member 37 to return to the regulating position D. The user depresses the regulating member 36 against the urging force of the urging member 37, and the regulating member 36 further returns to the previous regulating position D, so that the urging force is released, so that moderate mount feeling can be provided. In this state, the portions-to-be-guided, 33*e*1 and 33*e*3 are prevented from the movement toward the upstream side with respect to the mounting direction by the regulating member 36. Therefore, even if the cartridge 33 tends to move toward the mounting direction upstream, the regulating member 36 regulates the movement, and the cartridge is not disengaged away from the unit 200. The permitting position E is the position of the regulating member 36 in which the regulating member 36 permits the mounting of the cartridge 33 (the position in which the regulating member 36 is pushed down in the direction of the arrow X5), and the regulating position D is the position in which the movement of the cartridge 33 is regulated ((a) of FIG. 14). The cartridge 33 is mounted to the unit 200 in the state that the portions-to-be-guided 33*e*1 and 33*e*3 are movable in the recess 32*la*. In this manner, when the user mounts the cartridge 33 into the unit 200, the rough mounting is satisfactory. In other words, the cartridge 33 may not be positioned relative to the unit 200 in the mounting and dismounting position B, and therefore, the mounting operation is simple. In this embodiment, the regulating member 36 is provided in the unit 200. However, the regulating member may be provided outside the unit 200.

The regulating member 36 may be provided in any proper position, if the disengagement of the cartridge 33 from the unit 200 can be prevented.

(Movement, to Image Forming Position, of Image Forming Unit)

As shown in FIG. 14B, when the mounting of each cartridge 33 relative to the unit 200 is completed, the user rotates the unit 200 toward the image forming position A. First, the user grips the grip 38 of the cartridge 33Y of the topmost stage of the unit 200, or grips the grip provided on the sub-frame 31 of the unit 200, and the user applies the force in the direction of the arrow X8 to the unit 200. The regulating portion 46 disengages from the portion-to-be-regulated 31*n*, and the unit 200 becomes rotatable. As shown in (b) of FIG. 8, the regulating portion 46 and the portion-to-be-regulated 31*n* are provided with the surfaces inclined relative to the arrow X8 which is the rotational direction of the unit 200. As shown in (c) of FIG. 8, by the rotational operation in the direction of the arrow X8 the portion-to-be-regulated 31*n* retracts the regulating portion 46 in the direction of the arrow Y1, so that it the unit 200 is rotated. The urging member 47 for urging a regulating member 46 in the direction of the arrow Y0 is provided with an elastic force exceeding a predetermined urging force. By this, the portion-to-be-regulated 31*n* does not separate from the regulating portion 46 in the mounting and demounting operation of the cartridge 33 in the mounting and dismounting position B of the unit 200. On the other hand, the regulation is released by the rotational operation by the user, because of the proper selection of the urging force. The unit 200 is rotated about the left shaft portion 45L and the right shaft portion 45R in the state of being supported by the positioning portion 80*a*. The user moves the unit 200 in the arrow X8, while griping the grip 38 or the grip 31*m*. The user may grip whichever of the grip 38 or the grip 31*m*. In this embodiment, the grip 38 provided in the cartridge 33Y is in the outside of the unit 200, and therefore, it is easy to grip it and easy to recognize it. In other words, the grip, 38 is placed in an outside position beyond the grip 31*m* with respect to the radial direction of the unit 200. The grip 38 is provided with a recess 38*b* into which the user can insert the hand. The recess 38*b* is outwardly opened in the radial direction of the unit 200, and therefore, it is easy to operate, when the user moves the unit 200. The grip 38 is griped in order to rotate the unit 200, from the mounting and dismounting position B to the before-mounting-demounting-position C of (a) of FIG. 15, or, from the mounting and dismounting position B to the image forming position A. It is griped in order to rotate the unit 200 which is in the before-mounting-demounting-position C or the image forming position A to the mounting and dismounting position B. The first grip, 38 is provided on the cartridge 33Y in the downstreammost position with respect to the rotational direction (direction of the arrow X9) from the image forming position A toward the mounting and dismounting position B, among the cartridges 33 (Y, M, C and K). When the cartridge 33Y is not mounted, it is preferable to grip the grip 31*m* provided on the frame 31. When the user operates the unit 200 while gripping the grip 38, the portions-to-be-guided (portions-to-be-regulated) 33*e*1 and 33*e*3 is prevented from the movement by the regulating member 36 placed in the regulating position D. Therefore, even if the force is somewhat applied to the cartridge 33Y in the direction of separating out of the unit 200 in moving the unit 200 while griping the grip 38, the cartridge 33 is limited by the regulating member 36, and therefore, the it does not disengage outwardly of the unit 200. In other words, the regulating member 36 limits the disengagement of the cartridge 33Y, when the unit 200 is rotated to a before-mounting-demounting-position C from the mounting and dismounting position B, when the unit 200 rotates to the image forming position A, and when the unit 200 rotates in the opposite direction. At this time, the regulating member 36 is placed in the regulating position D. The urging force of the urging member 37 which urges the regulating member 36 is set such that the outward movement of the portions-to-be-guided 33*e*1 and 33*e*3 is limited, when the user rotates the unit 200 while griping the grip 38. The urging force is set such that in the mounting and dismounting position B, the portions-to-be-guided 33*e*1 and 33*e*3 move the regulating member 36 to the permission position E in accordance with the user's mounting and demounting operation, thereby to ride over the regulating member 36. Also in the other cartridges 33 (33M, 33C and 33K), the portions-to-be-guided 33*e*1 and 33*e*3 are regulated by the regulating member 36, and therefore, they do not disengage outwardly of the unit 200. The upper and lower portions of the portions-to-be-guided 33*e*1, 33*e*3 is regulated also by the mounting portion 32*l*, and therefore, even if the user moves the unit 200 in the directions of the arrows X8, X9, while griping the grip 38, the cartridge 33Y does not disengage. In the main assembly 100A, the top surface of a lower side stay 110*c* of the main frame 110 is provided with the spring member (urging member) 48. When the unit 200 is rotated from the mounting and dismounting position B of (b) of FIG. 14 to the image forming position A, the lower surface of the frame 31 of the unit 200 contacts to the above described spring member 48 in a position C before the image forming position A, as shown in (a) of FIG. 15. FIG. 16B is an enlarged view of the unit 200 of (a) of FIG. 15. Therefore, even if the user rotates the unit 200 downwardly with a quite strong force, such a force can be accommodated by the elastic force of the spring member) 48. The urging force of the spring member 48 is sufficiently larger than the force by the weight of the unit 200, and therefore, the unit 200 is rested in the state of receiving the urging force from the spring member 48. At this time, a portion-to-be-regulated-in-rotation 31*l* ((b) of FIG. 6) of the unit 200 is not abutted to the rotation regulating portion 80*c* ((a) of FIG. 7) provided on the guiding plate 80R, and therefore, it is in a position before the image forming position A. This position is a before-mounting-demounting-position C. The provision of the spring member 48 can prevent the breakage of the members in the unit 200, the cartridge 33, the photosensitive member unit 32, and the main assembly 100A attributable to the impact and so on, when the user rotates the unit 200. The spring 48 may be provided in the unit 200, and what is necessary is just to provide it between the unit 200 and the main assembly 100A. In other words, in moving the unit 200 from the mounting and dismounting position B to the image forming position A, it may be interposed between the unit 200 and the main assembly 100A. In this embodiment, as the spring member 48, the leaf spring member is used, but it may be a coil spring or the like. Depending on the weight of the unit 200, the cartridge 33 and so on inserted there, the spring member 48 may be omitted. FIG. 17 is a view in the case of the spring 48 being omitted. In this case, the lower surface of the sub-frame 31 is directly received by the top surface of the lower side stay 110*c* of the main frame 110 not through the before-mounting-demounting-position C, so that it is placed in the image forming position A. As shown in (a) of FIG. 15, in the state that the unit 200 is placed in the before-mounting-demounting-position C, the user stops the gripping of the grip 38 or the grip 31*m*, and moves the cover 10 from the open position H to the closing position G ((b) of FIG. 15). When the cover 10 is rotated to the position before the closing position G, the urging spring (urging member) 35 provided in an inner surface of the cover 10 contacts to the portion-to-be-urged 31*p* (FIG. 6) provided on the top plate 31C of the frame 31 of the unit 200 placed in the before-mounting-demounting-position C. Also thereafter, the cover 10 is rotated in the closing direction against the urging forces of the spring 35 and the spring member 48. Since the urging force of the urging spring 35 is larger than the urging force of the spring member 48, the unit 200 abuts the shaft portions 45L, 45R to the positioning portion 80*a* against the urging force of the spring member 48. Furthermore, the portion-to-be-regulated-in-rotation 31*l* is contacted to the rotation regulating portion 80*c* provided on the guiding plate 80R. By this, the unit 200 is positioned in the image forming position A relative to the main assembly 100A. As shown in (b) of FIG. 9, the locking claw portion 10*b* provided in the cover (10) side corresponds to a locking claw portion 136*a* provided in the button (136) side. When the cover 10 sufficiently moves to the closing position G by the further rotation of the cover 10 in the closing direction, then the cover 10 side locking claw portion 10*b* latches with the locking claw portion 36*a* of the button 36 side, as shown in (a) of FIG. 9. By this, the cover 10 is locked with the closing position G. The cover 10 is urged in the open direction by a compressive reaction forces (elastic forces) of the spring 35 and the spring member 48, but, the locking claw portions 10*b*, 36*a* fix to the main assembly 100A, as has been described in the foregoing. For this reason, the unit 200 rest in the image forming position A by being pressed to the main assembly 100A by the spring 35 ((b) of FIG. 1 and (a) of FIG. 16). More particularly, the unit 200 is locked with the image forming position A by the cooperation of the cover 10, the cover side locking claw portion 10*b*, the button (136) side locking claw portion 10*b*, the spring 35, the portion-to-be-regulated-in-rotation 31*l*, and the rotation regulating portion 80*c*. In this embodiment, the spring 35 is mounted to the cover 10. However, the urging spring may be provided in the unit 200, wherein a part of cover 10 is contacted to the urging spring. In other words, the structure may be such that it is interposed and contacted between the unit 200 and the cover 10 in interrelation with the closing operation of the cover 10. The main assembly 100A is provided with a cartridge urging member 51 (51*a*-51*d*) for urging each cartridge 33 toward the associated photosensitive member unit 32 in the state that the unit 200 is placed in the image forming position A. The urging member 51*a*-51*d* is provided at the longitudinal opposite end portions of the cartridge 33, and each cartridge 33 is provided with the two urging members. The urging members 51*a*-51*d* are sequentially contacted to the rear end portions of the cartridges 33 in accordance with the rotational operation of the unit 200 toward the image forming position A. The urging members 51*a*-51*d* sequentially contact to the cartridge 33, and therefore, the mounting property can be improved. In other words, as compared with the type in which all the urging members 51 are contacted at once, the load applied by the urging members 51 can be dispersed, so that the load required for the operation is reduced. As shown in FIG. 1B, when the unit 200 is placed in the image forming position A, the cartridge 33 is urged in the direction of the arrow Y2 by the urging member 51. The developing roller 33*b* in the cartridge 33 is contacted by the constant urging force to the drum 32*a* by contacting the regulation rollers 60 (FIG. 5) provided at the opposite ends thereof to the drum 32*a*. The urging force by the urging member 51 can satisfactorily maintain the contact state (or spacing state) between the developing roller 33*b* and a drum 32*a*. When the unit 200 which mounts the cartridge 33 is placed in the image forming position A, the portions-to-be-guided 33*e*1, 33*e*3 provided in the cartridge 33, are in the positions free of the urging force by the regulating member 36, as shown in (a) of FIG. 16. In other words, the portions-to-be-guided 33*e*1 and 33*e*3 are in the position of not contacting to the regulating member 36. At this time, gap g is provided between the portions-to-be-guided 33*e*1 and 33*e*3 and the regulating member 36. Therefore, the urging force of the urging member 37 which urges the regulating member 36 is not influential to the urging force of the cartridge 33 relative to the unit 32. Therefore, the urging force of the cartridge 33 can be maintained with high precision. It is satisfactory that the gap g is such that, when the cartridge 33 moves from the mounting and dismounting position B to the image forming position A, (or the opposite direction), it does not contact to the member of the main assembly 100A and so on (except for the cartridge urging members 51*a*-51*d*). By doing so, the accuracy of the urging force of the cartridge 33 relative to the drum 32*a* is enhanced, and the operation of the stabilized unit 200 is accomplished. By the above-described operation, the device 100 becomes in the state that an image forming operation (print operation) can be carried out, and the image forming operation described above is carried out on the basis of an image formation start signal (print start signal). The drive outputting portion (unshown) of the main assembly (100A) side is coupled with the gear 34*b* of the drive inputting portion of the transfer member 34 of the unit 200 placed in the image forming position A. The drum gear 32*a*1 of each photosensitive member unit 32 couples with the gear 34*b*. The gear 50 of the developing roller 33*b* of each cartridge 33 is coupled therewith. The electric power supply system of the main assembly side is electrically connected to the electrical contacts of the photosensitive member units 32 and the cartridges 33. By this, the image forming apparatus 100 is capable of carrying out the image forming operation. In this embodiment, the scanner unit 11, the cartridge 33, the drum 32*a*, the transfer member 34, and the feeding path Z for the recording material S are disposed substantially in parallel with the installation surface F, as shown in FIG. 1B. In the upper portion of the device 100, the cover 10 functioning also as the discharging tray is provided, and the cassette 19 is disposed at the lower portion of the device 100. The laser beams L from the unit 11 (Y, M, C and K) is projected with the drum 32*a* from behind the cartridge 33. The color developer image transferred onto the transfer member 34 from each drum 32*a* is transferred onto recording material S in the opposite side from each drum 32*a* with respect to the transfer member 34. Furthermore, according to this embodiment, the unit 200 can be rotated between the image forming position A and the mounting and dismounting position B in the state that the drum 32*a* is mounted to the unit 200, and the cartridge 33 is dismountably mounted to the unit 200 (mounting portion 31*c*). By rotating the unit 200 from the image forming position A to the mounting and dismounting position B, the cartridge 33 is mounted and demounted relative to the unit 200. By such a structure, the device 100 can be downsized.

(Exchange of Cartridge and Residual Developer Container)

In each of the cartridges 33, the developer contained in the developer accommodating portion 33*c* of the cartridge 33 is consumed as it is used for the image formation. In view of this, means (unshown) for detecting a developer remainder of each cartridge 33, for example, is provided, and the control circuit portion 300 compares a detected remaining amount value with the threshold for a cartridge lifetime forenotice or a lifetime warning set beforehand. As for the cartridge 33 exhibiting less detected remaining amount value than the threshold, the lifetime forenotice or the lifetime warning of such a cartridge 33 is displayed on the display portion 102 (FIG. 1A) provided in an operating portion 101 of the image forming apparatus 100. Or, the lifetime forenotice or the lifetime warning about the cartridge 33 thereof is displayed on the display portion (unshown) of the external host device 400. By this, a preparation of the cartridge 33 for the exchange is prompted, or, the exchange of the cartridge is prompted for the user, to maintain the quality of the output image. Also with respect to the container 40, it is detected that the inside of the container contains the residual developer more than the predetermined level, and the event is displayed on the display portion 102 and so on to prompt the user to the exchange of the container 40. In the image forming apparatus 100 of this embodiment, in an exchange of each cartridge 33 and the container 40 mounted to the unit 200, the opening 100B of the top side of the main assembly 100A is opened. As shown in FIG. 1B, for the closure releasing of the cover 10 locked at the closing position G, the user pushes a button 36 on the front side of the main assembly 100A, as shown by the chain lines in (a) of FIG. 9. When the user pushes a button 36 rearwardly against the spring (unshown), the locking claw portion 36*a* on the button (36) side escapes from the locking claw portion 10*b* on cover (10) side backwardly to release the latch engagement, as indicated by chain lines. In this manner, the cover 10 is pushed up by the compressive reaction forces (elastic forces) of the spring 35 and the spring 48. The cover 10 is rotated in an open direction from the main assembly 100A by an angle corresponding to an operation distance (restoration length to a free length) of the spring 35 and spring member 48 about the hinge shaft 10*a*. More particularly, the cover 10 becomes partly open state automatically by the elastic forces of the spring 35 and the spring member 48. Part (b) of FIG. 9 and (b) of FIG. 15 show the partly open state of the cover 10. Thereafter, when the user lifts the finger from the button 36, the force (elastic force) of the urging spring (unshown) restores it to the previous position. At this time, since locking claw portion 10*b* is positioned at an upper position by the above described partly opening movement of the cover 10, it is not engaged in the restored locking claw portion 36*a* ((b) of FIG. 9). The user hangs a fingers on a grip portion 10*d* of the cover 10 in the partly open state, and opens the cover 10 by a manual operation to the open position H, as shown in (a) of FIG. 15. The cover 10 is sufficiently opened to the open position H it so that it is received by a stopper portion of the main assembly side, and thereafter, even if the user moves the hand off, the state is maintained stably. Or, it is locked by a click stop mechanism and a catching mechanism to stably maintain the opening state even if the user moves the hand off since then. By this, the opening portion 100B in the upper side of the main assembly 100A is sufficiently opened greatly. The unit 200 is released from the urging force (a pressing) by the urging spring 35 by the releasing of a locking of the cover 10 relative to the closing position G. By this, the unit 200 is moved from the image forming position A to the before-mounting-demounting-position C by the urging force of the spring member 48. The unit 200 moved to the before-mounting-demounting-position C is exposed through the opened opening portion 100A. The user can see the unit 200 moved to the before-mounting-demounting-position C, and the subsequent the direction of the operation of the unit 200 is suggested. In other words, the user looking in the movement (direction of the arrow X9) toward mounting and dismounting position of the cartridge 33 mounted to the unit 200 can feel the next operation, in the direction of the arrow X9, of the unit 200 intuitively, and therefore, it assists the user's operation. The grip 38 of the cartridge 33Y and the grip 31*m* of the frame 31 pop out in the rotational direction (toward the opening 100B) of the unit 200, and therefore, the user recognizes the grip 38 and the grip 31*m* easily and can carry out the subsequent operation correctly. While the user grips the grip 38 or the grip 31*m*, the user rotates or moves the unit 200 in the direction of the arrow X9 to place the unit 200 in the mounting and dismounting position B (FIG. 14B). In the case where the spring 48 is not used (FIG. 17), the user moves the unit 200 placed in the image forming position A to the mounting and dismounting position B, while griping the grip 38 or the grip 31*m*. The portion-to-be-regulated 31*n* of the unit 200 placed in the mounting and dismounting position B is engaged with the main assembly 100A side regulating portion 46, as described above. In this manner, the unit 200 is temporarily fixed in the mounting and dismounting position B (l, so that n the movement toward the image forming position A is limited. In this state, the cartridge 33 and the container 40 or the cartridge 33 or the container 40 is dismounted in the opposite direction. In other words, when the unit 200 is placed in the mounting and dismounting position B, the cartridge 33 and the container 40 is detachably mountable relative to the unit 200. In the container 40, the portion-to-be-locked (guide portion) 31*m*2 separates from the locking portion (urging member) 49 in interrelation with the dismounting operation from the unit 200. In this manner, the container 40 can be taken out to an outside of the unit 200. The container 40 is provided with discrimination means which shows that it is not a cartridge 33. Therefore, the cartridge 33 and the container 40 carried on the same unit 200 are not mixed up, when the user exchanges them. The discrimination means is sufficed if the user can discriminate visually, and in an example, the container 40 and the cartridge 33 are provided with the different labels. In another example, the outer appearance of the container 40 is different from that of the cartridge 33. The container 40 may be a transparent container, and in this case, the user can recognize easily that the residual developer is contained in the inside. When these examples are combined together, the assured discrimination is accomplished. In this embodiment, the image forming apparatus is a color image forming apparatus which is provided with a plurality of cartridge, but it may be a monochromatic image forming apparatus which is provided with a single cartridge. In this case, the inside of the unit demountably carries the single cartridge and the single residual developer containing container. Here, as for the cartridge, 33Y placed in the downstreammost side with respect to the rotational direction X9 from the image forming position A to the mounting and dismounting position B, the mounting and dismounting operation is capable also in the before-mounting-demounting-position C. Referring to FIG. 1, this will be described. As described above, the mounting portion 32*lh* of the cartridge 33Y is divided into the first mounting portion 32*l*1 and second mounting portion 32*l*2. The first mounting portion 32*l*1 is used in the mounting and dismounting position B, and therefore, the cartridge 33Y is detachably mountable relative to the unit 200 (FIG. 14A and FIG. 18). In the before-mounting-demounting-position C (or mounting and dismounting position B), the first mounting portion 32*l*1 or the second mounting portion 32*l*2 is used, and therefore, the cartridge 33Y is detachably mountable relative to the unit 200. As indicated by a chain line in FIG. 14A, the cartridge 33Y is detachably mountable relative to the unit 200 in the direction of the arrow Y3, and the direction of the arrow Y4. As shown in FIG. 17, when the spring member 48 is omitted, the mounting and demounting of the cartridge 33Y is possible in the image forming position A. More specifically, in the mounting of the cartridge 33Y, the portions-to-be-guided 33*e*1 and 33*e*3 of the cartridge 33Y are placed correspondingly to second mounting portion 32*l*2 in the upper portion of the first and second mounting portions 32*l*1 and 32*l*2. The portions-to-be-guided 33*e*2 and 33*e*4 are placed correspondingly to first mounting portion 32*l*1 ((a) of FIG.

19). The cartridge 33Y is moved in the direction of the arrow Y3. By this, the portions-to-be-guided 33*e*1 and 33*e*3 enter the recess 32*la* of the second mounting portion 32*l*2 (recess 32*la* rearward beyond position of regulating member 36). The portions-to-be-guided 33*e*2, 33*e*4 enters the recess 32*la* in front of the position of the regulating member 36 ((b) of FIG. 19). Furthermore, the cartridge, 33Y is moved downstream with respect to the mounting direction of the arrow Y6. By this, the cartridge 33Y is mounted to the unit 200 ((c) of FIG. 19). When dismounting the cartridge 33Y from the unit 200 on the contrary, in the before-mounting-demounting-position B (or image forming position A), the user moves the cartridge 33Y to the method improvement style side of the mounting of the arrow Y5 while gripping the first grip 38. Thereafter, by raising a cartridge 33Y in the direction of the arrow Y4, the portions-to-be-guided 33*e*1, 33*e*3 separate from the second mounting portion 32*l*, and the portions-to-be-guided 33*e*2, 33*e*4 separate from the first mounting portion 32*l*1. By this, the cartridge 33Y is dismounted from the unit 200. It crosses in the course of the paths of the first mounting portion 32*l*1 and the second mounting portion 32*l*2, and therefore, cartridge 33Y can mount and demount in two different directions. The sub-frame 31 of the unit 200 is provided with a cut-away portion 31*q* for the cartridge 33Y, and therefore, the cartridge 33Y can be dismounted upwardly using the second mounting portion 32*l*2. The cartridge 33Y can be mounted downwardly using the second mounting portion 32*l*2. The notch 31*q* has the concave shape constituted by side plates 31L, 31R and the top plate 31C. With the structure as described above, the cartridge 33Y can be mounted and demounted without moving the unit 200 to the mounting and dismounting position B, and therefore, the operativity for the user is improved. With the structure of the above-described image forming apparatus, the exchange of the cartridge 33 is possible, without retracting a scanner unit (image exposure device) 11. By this, the user can exchange the cartridge 33 easily. The transfer member 34 is in the form of a drum, and the unit 200 is rotatable about the center axis of the transfer member 34. By this, it is not necessary to greatly retract the member in the main assembly 100A in the movement of the unit 200 between the image forming position A and the mounting and dismounting position B. The internal cartridge 33 is exchangeable without drawing the unit 200 out of the main assembly 1010A, and therefore, the device 100 is downsized. In this embodiment, the transfer member is the transfer member 34 for transferring the image indirectly onto the recording material S from the drum 32*a*. However, this is not inevitable, and it may be of the type of transferring the image directly onto the recording material S from the drum 32*a*. At this time, the transfer member 34 transfers the developed image directly from the drum 32*a* onto the recording material S. In this embodiment, the cartridge which is to be exchanged is the developing cartridge 33 used for the process cartridge of the discrete type. However, this is not restrictive, and the cartridge which is to be exchanged may be the process cartridge which unifies the unit 32 and the cartridge 33. The structure of the image forming apparatus 100 of the above-described Embodiment 2 is summarized as follows. The apparatus is an electrophotographic color image forming apparatus 100 for forming a color image on recording material S. It is provided with a plurality of the cartridges 33 (Y, M, C and K) which contain the developers. It is provided with an image forming unit 200. The unit 200 is provided with the transfer member 34 for transferring the developer image formed on the electrophotographic photosensitive drum 32*a* onto the recording material S and the cartridge mounting portion 32*l* for mounting the cartridge 33. The unit 200 is movable between the image forming position A for carrying out the image formation and the mounting and dismounting position B away from the position A where the cartridge is mountable and demountable relative to the main assembly 100A of the device 100 in the state that the cartridge 33 is mounted. It is provided with a cleaning member 32*c* for removing the developer which remains on the surface of the drum 32*a*. It is provided with a residual developer container 40 which contains the developer removed by the cleaning member 32*c* and is and which mounted to the unit 200. The container 40 is detachably mountable relative to the unit 200, when the unit 200 is placed in a position B. It is provided with the feeding member, 32*e* for feeding the developer removed by the cleaning member 32*c* in the axial direction of the drum 32*a*, and the container 40 is provided in the downstream side with respect to the feeding direction of the feeding member 32*e*. The drum 32*a*, the cleaning member 32*c*, and the feeding member 32*e* are contained in the inside of a photosensitive member unit 32*d*, and the unit 32*d* is mounted to the unit 200. The mounting and demounting direction of the container 40 is the same as the mounting and demounting direction of the cartridge 33. The container 40 is provided with the grip 42*a* for mounting and demounting it relative to the unit 200. The unit 200 is provided with a guide portion 31*m* (1-3) for mounting and demounting the container 40 relative to the unit 200, and the container 40 is provided with the portions-to-be-guided 41 (*d, e, f*) guided by a guide portion 31*m* (1-3). The guide portion 31*m* (1-3) is provided on the outside surface of the unit 200. An end of the feeding member, 32*e* is provided with a drive transmitting portion 32*i* for transmitting the drive to the feeding member, and the container 40 is provided at the side opposite from the side which is provided with the drive transmitting portion 32*i* with respect to the axial direction of the drum 32*a*. The unit 200 is rotatable between the position A and the position B.

Embodiment 2:

A second embodiment of the present invention will be described. Significantly different points from Embodiment 1 will be described. The residual developer container 40 for containing the developer which remains on the surface of the drum 32*a* is employed in Embodiment 1. In this embodiment, the residual developer container for accommodating the developer which remains on the transfer member directly is used.

(General Arrangement of the Image Forming Apparatus)

Part (a) of FIG. 20 is a vertical section left side view of an image forming apparatus 300 of this embodiment, and (b) is an illustration of the mounting and demounting process of a cartridge Q and a residual developer container 340. The image forming apparatus 100 is a laser printer of a full-color (four color) type which uses an electrophotographic process, similarly to Embodiment 1. The device 300 comprises a main assembly 300A, in which the four electrophotographic photosensitive drums 301 are horizontally juxtaposed and shafts thereof are extended in the front-rear direction. Around each drum 301, there are provided charging means (charging roller) 302 for charging the surface of the drum 301 uniformly, a scanner unit for projecting the laser beam on the basis of the image information and forming an electrostatic latent image on the drum 301 303 in the order named in a rotational direction of the arrow. Furthermore, there are provided a developing roller for developing the electrostatic latent image using the toner 304, and the intermediary transfer member for transferring a toner image (developer image) onto the recording material S from the drum 301 (transfer member) 305 which opposes the drum 301. In addition, the cleaning means 306 for removing the developer which remains on a drum 301 surface after the transferring of the image is provided. Here, the drum 301, the charging means 302, the developing roller 304, and the cleaning means 306 constitutes an integral cartridge (process cartridge) (Y, M, C and K) Q. As for the description of the cartridge Q, a first cartridge QY will be described. A cartridge QY accommodates a yellow (Y) developer, and forms a Y color developer image on the surface of the drum 301. A second cartridge QM accommodates a magenta (M) developer, and forms an M color developer image on the surface of the drum 301. A third cartridge QC accommodates a cyan (C) developer, and forms a C color developer image on the surface of the drum 301. A fourth cartridge 33K accommodates a black (K) developer, and forms a K color developer image on the surface of the drum 301. In a position adjacent to the first cartridge QY, a cleaning member 341 for removing the residual toner deposited on the transfer member 305 and the residual developer container 340 for containing the residual developer removed by the cleaning member 341 are provided. Each cartridge Q can be exchanged, when the toner is used up by the image formation. The container 340 can be exchanged, when it contains the residual developer more than a predetermined amount. Furthermore, the container 340 is provided with the discrimination means for showing that it is not a cartridge Q. Therefore, they are carried on a common supporting member 345, but the user does not mix up at the time of exchange. The discrimination means suffices if the user can discriminate visually, and in an example, the container 40 and the cartridge 33 are provided with different labels. In another example, the outer appearance of the container 40 is different from that of the cartridge 33. The container 40 may be a transparent container, and in such a case, the user can recognize easily that the residual developer is contained in the inside. The combination of these examples accomplishes the assured discrimination. The operation for forming a full-color image will be described. The drum 301 of each cartridge Q is rotationally driven at a predetermined controlled speed in a counterclockwise direction indicated by an arrow in FIG. 20A. A roller 302 is rotated by the drum 301. The transfer member 305 is rotationally driven at the speed corresponding to the speed of the drum 301 in the clockwise direction (codirectional with the rotation of the drum 301) of the arrow. The transfer member 305 is an endless belt of the dielectric member which has flexibility, and is extended and stretched around a driving roller 305*a*, the secondary transfer opposing roller 305*b*, and a tension roller 305*c*. The developing roller 304 and a supplying roller 307 are rotationally driven at the predetermined controlled speeds. The scanner unit 303 is driven. In synchronism with this drive, a predetermined charging bias voltage is applied to the charging roller 302 at the predetermined controlled timing in each cartridge Q. By this, the surface of the drum 301 is uniformly charged by the charging roller 302 to the predetermined polarity and predetermined potential. The scanner unit 303 scanningly exposes the surface of each drum 301 to the laser beams L (LY, LM, LC and LK) modulated in accordance with the corresponding Y, M, C and K image signals. By this, the electrostatic latent image corresponding to the correspondence color image signals is formed on the surface of the drum 301 of each cartridge Q. In each cartridge Q, the electrostatic latent image formed on the surface of the drum 301 is developed into a developer image by the developing roller 304. The developing roller 304 is supplied with a predetermined developing bias voltage at the predetermined controlled timing in each cartridge Q. Through the above-described electrophotographic image forming process operation, a Y color developer image corresponding to a yellow component of the full-color image is formed on the drum 301 of the cartridge QY. The developer image is transferred (primary transfer) onto the transfer member 305 in a primary transfer nip which is the contact portion between the drum 301 and the intermediary transfer member 305. Designated by 309 is a primary transfer roller, and is press-contacted to the drum 301 interposing the transfer member 305. By this, the primary transfer nip is formed. Hereinafter, similarly, the Y color developer image is transferred (primary transfer) onto the transfer member 305 through the drum 301 in a cartridge QM Y, and the C color developer image is transferred (primary transfer) in a cartridge QC C, and the K color developer image is transferred (primary transfer) in a cartridge QK K. In this way, a full-color developer image of the Y color +M color +C color +K color is synthetically formed on the transfer member 305. The order of the colors of the developer images sequentially superimposedly transferred onto the transfer member 305 is not limited to the above described order. In each cartridge Q, the untransferred developer which remains on the drum surface after the primary transfer of the developer image onto the transfer member 305 is removed by the blade (cleaning means) 306, and is fed to a cleaning container 308. On the other hand, the feeding roller 320 is driven at the predetermined controlled timing. By this, the sheet-like recording material S stacked in the feeding cassette 319 is fed. The recording material S is introduced into the secondary transfer nip which is the contact portion between the transfer member 305 and the secondary transfer roller 322, at the predetermined controlled timing by the registration roller couple 318. The secondary transfer roller 322 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 305 on which it is superimposed is sequentially transferred (secondary transfer) onto the surface of recording material S. The recording material S passed through the secondary transfer nip is separated from the surface of the transfer member 305 and is introduced into the fixing device 323, where it is heated and pressed by a fixing nip. By this, the color developer images are mixed and fixed on recording material S. The recording material S is discharged out of the fixing device 323, and is discharged on the discharge tray 310 which functions as a discharging tray by discharging roller pair 324 as a full-color print. In this embodiment, the roller 322 is movable between a first position in which it contacts to the transfer member 305 and forms the secondary transfer nip and a second position spaced from the transfer member 305 by a shifting mechanism (unshown). At the time of an image forming operation of the image forming apparatus 100, the roller 322 is moved to the first position, and at the time of then no-image formation, it is moved to the second position. The roller 322 may normally be contacted with the intermediary transfer member 305. After the recording material S is separated from the surface of the transfer member 305, the toner remaining after the secondary transfer on the surface of the transfer member 305 is electrostatically deposited onto the surface of a cleaning roller 342 as the cleaning member 341. The deposited toners are scraped by a cleaning blade 343 contacted to the roller 342, and is accommodated into the container 340. Here, the combination of the cleaning roller 342 and the cleaning blade 343 is called the cleaning member 341. The cleaning blade 343 may directly be contacted to the surface of the transfer member 305, without using the cleaning roller 342. In the device 100 of this embodiment, the cartridge Q and the container 340 are carried on the supporting member 345 which is the frame member of the drawer type, wherein the exchange of the cartridge Q and the container 340 is carried out with a front access type. The supporting member 345 supports the cartridges Q (Y, M, C, and K) arranged in one direction. The container 340 is provided adjacent to the cartridge s Q with respect to the direction. When the cartridge Q and the container 340 are mounted and demounted relative to the main assembly 300A, the supporting member 345 is drawn to the mounting and dismounting position B of the outside of the main assembly 300A, as shown in FIG. 20B. In the mounting and dismounting position B, the cartridge Q and the container 340 are dismountable. The cartridge Q and the container 340 are mounted and demounted relative to a cartridge mounting portion 345*c* and a container mounting portion 345*d* of the supporting member 345 in the state of being drawn to the position B, respectively. The supporting member 345 which mounts the cartridge Q and the container 340 is pushed into the position A in the main assembly 300A, as shown in FIG. 20A. In this manner, the cartridge Q and the container 340 is moved to the image forming position for carrying out the image formation and the cartridge Q and the container 340 are mounted to the inside of the main assembly 100A. Therefore, the mounting and dismounting operativity of the cartridge Q and the container 340 relative to the main assembly 300A can be improved. The front side of the main assembly 300A is provided with a front opening 300B. The opening portion 300B passes the supporting member 345 supporting the cartridge and the container 340, when the cartridge Q and the container 340 are pushed into the main assembly 300A, or when the cartridge Q and the container 340 are drawn from the main assembly 300A. The front side of the main assembly 300A is provided with a rotatable door 330. The door 330 is movable between the closed position for closing the opening portion 300B and the open position for opening the opening portion 300B (opening and closing member). In this embodiment, the door 330 is rotatable relative to the main assembly 300A about a hinge portion 330*a* placed in the lower side of the door. In more detail, the door 330 can close the opening portion 300B by rotating upwardly about the hinge portion 330*a*, as shown in FIG. 20A. The door 330 can open the opening portion 300B by rotating downwardly about the hinge portion 330*a*, as shown in FIG. 20B. In more detail, the supporting member 345 is movable between the position A in the main assembly 300A for dismountably supporting the cartridges Q, and the container 340 and the position B outside of the main assembly 300A. The supporting member 345 is moved to the front-rear direction along guiding means through the opening portion 300B in the state that the door 330 is opened. In this embodiment, the guiding means comprises the guiding grooves 300C which oppose to the insides of the left and right side walls of the main assembly 300A and which are substantially horizontally extended, and a portion-to-be-guided 345*a* which is provided in each of the left and right sides of the supporting member 345 and which is slidably engaged with the guiding groove 300C. In more detail, the supporting member 345 is movable relative to the main assembly 300A in the direction of the arrow D1 which is a substantially horizontal direction (the pushing-in direction and the rearward direction) and in the opposite D2 direction (drawing direction and frontward direction). Each cartridge Q and the container 340 are arranged so that in the state that those longitudinal directions are adjacent to each other in the movement direction (arrows D1, D2) of the supporting member 345, and it is mounted and supported by the associated mounting portions 345*c*, 345*d* of the supporting member 345. The longitudinal direction of the cartridge Q is parallel with the axial direction of the drum 301, and the longitudinal direction of the container 340 is parallel with the axial direction of the roller 304. In more detail, the supporting member 345 supports the cartridges Q (Y, M, C, and K) and the container 340 adjacent to each other. The supporting member 345 supports the cartridges Q and the container 340, so that n the longitudinal directions thereof are the direction crossing with the D1 direction (D2 direction) (substantially orthogonal direction). Therefore, the user can carry out the exchange of the container 340 and the exchange of the cartridge Q similarly, and therefore, the usability is excellent. The supporting member 345 can move the cartridge Q and the container 340 between the image forming position A in the main assembly 300A and the mounting and dismounting position B in the state that the door 330 is opened. In the position B, the supporting member 345 is drawn from the position A, and the cartridges Q and the container 340 can be mounted and demounted. In the position A, the supporting member 345 supports the cartridges Q and the container 340, and the electrostatic latent image can be formed on the drum 301 inside the main assembly 300A. In more detail, each cartridge Q is in the regular mount position relative to the main assembly 300A. Each drum 301 contacts to the transfer member 305, and the developer image can be transferred onto the transfer member 305 from the drum 301. In the position A, each cartridge Q is pushed by the urging member to be fixed to the predetermined positioning portion (unshown). In this state, the drive outputting portion (unshown) provided in the main assembly 300A is in engagement with the drive inputting portion (unshown) of each cartridge Q. An electric power supply system (unshown) provided in the main assembly (300A) is electrically connected to an electrical contact (unshown) of each cartridge Q. The cleaning roller 342 of the container 340 contacts to the transfer member 305, and the toner remaining after the secondary transfer can be caught from the transfer member 305. When the door 330 is opened, the opening portion 300B is opened. By this, the grip portion 345*b* provided on the front side of a front frame of the supporting member 345 is exposed. By an interrelating mechanism (unshown) in interrelation with the opening rotation operation of the door 330, a driving roller (305*a*) of the transfer member 305 lowers to the predetermined position about a rotational axis of the transferring opposing roller 305*b*. By this, the transfer member 305 is spaced from the lower surfaces of the drum 301 of each cartridge Q and the cleaning roller 342 of the container 340. In more detail, a contact of the transfer member 305 to the drum 301 and the roller 342 is released. The connection of the drive outputting portion of the main assembly (300A) side with the drive inputting portions of each cartridge Q and the container 340 is released (drive releasing). The pressing of the urging member which positions and fixes each cartridge Q is released (pressing releasing). The electrical connection to the electric power supply system of the main assembly (300A) side to the electrical contact of each cartridge Q is released (electric power supply releasing). The positioning and fixing by the moving and positioning means of the supporting member 345 relative to the main assembly 300A is released. In view of this, while griping the grip portion 345*b*, the user horizontally slides the supporting member 345 in the frontward direction which is the drawing direction D2 from the main assembly 300A. The user sufficiently draws the supporting member 345 to the position B outside of the main assembly 300A through the opening portion 300B. In more detail, the supporting member 345 is sufficiently drawn to the outermost side position B. At this time a stopper member (unshown) prevents the further drawer movement. At the time of the drawing movement of this supporting member 345, the drum 301 of each cartridge Q and the roller 342 of the container 340 are spaced from the transfer member 305. Therefore, the rubbing therebetween does not occur. The each cartridge Q and the container 340 are supported by moving to the supporting member 345 downwardly, and they can be taken out upwardly. In view of this, the user raises and removes the used cartridge Q from the supporting member 345 (arrow of (b) of FIG. 20 C2). Then, the user drops a new cartridge Q on the supporting member 345 (down-arrow C2). In this manner, the cartridge Q is supported by the supporting member 345. In the state that the supporting member 345 is placed in the position B, the user can mount and demount the container 340 in the direction of the arrow C1, C2 from the supporting member 345. In more detail, the cartridge Q and the container 340 are mounted and demounted relative to the supporting member (C1, C2) 345 in the substantially vertical direction. When the user finishes an exchanging operation of the cartridge Q and/or the container 340, the supporting member 345 is horizontally slid in the rearward direction which is the pushing-in direction D1 opposite to the drawing direction D2 relative to the main assembly 300A. The user sufficiently pushes it into the main assembly 300A from the position B. Then, the stopper member (unshown) prohibits the further insertion. At the time of the pushing-in movement of the supporting member 345, the drum 301 of each cartridge Q and the cleaning roller 342 of the container 340 are spaced from the transfer member 305, and therefore, the rubbing therebetween does not occur. The user closes the door 330, after inwardly pushing the supporting member 345 in sufficiently. The opening portion 300B and the opening portion 300B are closed by the closing operation of the door 330. By the interrelating mechanism in interrelation with the closing operation of the door 330, the supporting member 345 is positioned and fixed by the moving and positioning means relative to the main assembly 300A. Each cartridge Q is pushed by the urging member (unshown), and is fixed to the predetermined positioning portion. The drive outputting portion of the main assembly (300A) side connects with the drive inputting portion of each cartridge Q and the container 340. The electrical contacts of each cartridge Q are electrically connected to the electric power supply system in the main assembly (300A) side. The roller (305*a*) side of the transfer member 305 rises to the predetermined position about the rotational axis of the roller 305*b*. By this, the transfer member 305 contacts to the lower surfaces of the drum 301 of each cartridge Q and the roller 342 of the container 340. In this state, the apparatus 300 can carry out the image forming operation. As has been described in the foregoing, in the state of being supported by the supporting member 345, the cartridges Q and the container 340 enter the main assembly 300A with the supporting member 345. Therefore, the user makes the supporting member 345 enter the main assembly 300A, and the door 330 is closed. By this, the cartridges Q and the container 340 can be assuredly mounted relative to the main assembly 300A. For this reason, the mounting and dismounting operativity is improved, as compared with the structure in which the user mounts the cartridges Q and the container 340 to the main assembly 300A individually. The container 340 is pressed toward the transfer member 305 by the urging member (unshown) in the position A. Therefore, the cleaning member 341 can collect the residual developer on the transfer member 305 assuredly. On the other hand, the pressing of the urging member is released in interrelation with the opening operation of the door 310, and the container 340 can be moved to the position B with the supporting member 345. Here, the container 340 is movable between a cleaning position contacting to the transfer member 305 to effect the cleaning operation and a spaced position where it is spaced from the transfer member 305 and it does not effect the cleaning operation, by the spacing mechanism (unshown). The container 340 is moved to the cleaning position, when the residual developer on the transfer member 305 is removed, and it is moved to the spaced position, when the removing operation is not carried out. However, the container 340 may normally be contacted to the transfer member 305. Only the cleaning member 341 may be moved between the cleaning position and the spaced position. As has been described in the foregoing, the container 340 is detachably mountable relative to the supporting member 345, and therefore, the user can carry out the exchange of the cartridge Q and the exchange of the container 340 through the same method, and therefore, it excels in the usability. The mounting and demounting direction of the container 340 and the mounting and demounting direction of the cartridge Q are the same, and therefore, the user can carry out those operations easily. Here, the same direction is not in the strict sense, but the directions may slightly be deviated, if the mounting and demounting of the container 340 and the cartridge Q can be performed, without changing the position of the supporting member 345. The container, 340 is disposed at the upstream-most side with respect to the direction (direction of the arrow D2) toward the position B from the position A of the supporting member 345. Generally, the container 340 is low in the exchange frequency as compared with the cartridge Q. Therefore, the container 340 which has the lowest exchange frequency is disposed in the main assembly (300A) side, and therefore, the user can exchange the cartridge Q which has the relatively high exchange frequency easily. In other words, since the user can exchange the cartridge Q without drawing the supporting member 345 to a front side so much, the usability is high. In this embodiment, the transfer member 305 transfers (primary transfer) the developed image from the drum 301, and transfers it (secondary transfer) onto the recording material S. However, the developed image may be directly transferred from the drum onto the surface of the recording material S by the transfer member. The substantially horizontality means substantial horizontality relative to the installation surface F of the apparatus 300. However, the supporting member 345 receives in the installation surface and may be horizontal movement toughness linearly F, and it may move linearly angularly upwardly or angularly downwardly relative to the installation surface F, for example. In this embodiment, the color image forming apparatus which includes a plurality of cartridge is exemplified, but the present invention is applicable to the monochromatic image forming apparatus which includes the single cartridge, similarly to Embodiment 2. The structure of the image forming apparatus 100 of the above-described Embodiment 2 is summarized as follows. The apparatus is an electrophotographic color image forming apparatus 300 for forming a color image on recording material S. It is provided with a plurality of cartridges Q (Y, M, C, and K) which contain the developers. It is provided with a transfer member 305, which opposes to the electrophotographic photosensitive drum 301, and which transfers the developer image formed on the drum 301 onto the recording material S. It is provided with the supporting member 345, which is movable between the position A for carrying out the image formation and the position B for permitting the dismounting of the cartridge away from the position A relative to the main assembly 300A of the apparatus 300 in the state that the cartridge Q is mounted. It is provided with a cleaning member 341 for removing the developer which remains on the surface of the transfer member 305, and it is provided with a container 340 for containing the developer removed by the cleaning member 341, which is a residual developer container

340 mounted to the supporting member 345. The container 340 is detachably mountable relative to the supporting member 345, when the supporting member 345 is placed in the position B.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 069961/2009 and 239164/2009 filed Mar. 23, 2009 and Oct. 16, 2009, respectively which are hereby incorporated by reference.

What is claimed is:

1. An electrophotographic image forming apparatus for forming an image on a recording material, comprising:

a cartridge for storing developer;

an intermediary transfer member, opposed to an eletrophotographic photosensitive drum, said electrophotographic photosensitive drum transferring a developed image formed on said electrophoto graphic drum onto said intermediate transfer member;

a transfer member for transferring a developed image borne on said intermediary transfer member onto the recording material;

a supporting member movable, while supporting a cartridge, between an image forming position for effecting image formation and a mounting and demounting position, away from the image forming position, for mounting and demounting said cartridge to said mounting portion;

a residual developer container, mounted to said supporting member and provided with a cleaning member for removing developer remaining on a surface of said intermediary transfer member, for accommodating the developer removed by said cleaning member;

wherein said residual developer container is detachably mountable relative to said supporting member when said supporting member is in the mounting and demounting position, and wherein said residual developer container is disposed such that in a state that said supporting member is in the image forming position, said cleaning member acts on the surface of said intermediary transfer member at a position downstream of said transfer member and upstream of said electrophotographic photosensitive drum with respect to a movement direction of said intermediary transfer member.

2. An according to claim 1, wherein said residual developer container is disposed at an upstream side of said cartridge with respect to a direction of said supporting member directing from the image forming position toward the mounting and demounting position.

* * * * *